US009443499B2

(12) United States Patent
Moriyama

(10) Patent No.: US 9,443,499 B2
(45) Date of Patent: Sep. 13, 2016

(54) MUSICAL SOUND CONTROL APPARATUS, MUSICAL SOUND CONTROL METHOD, PROGRAM STORAGE MEDIUM AND ELECTRONIC MUSICAL INSTRUMENT

(71) Applicant: CASIO COMPUTER CO., LTD., Shibuya-ku, Tokyo (JP)

(72) Inventor: Osamu Moriyama, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/861,472

(22) Filed: Sep. 22, 2015

(65) Prior Publication Data

US 2016/0086589 A1 Mar. 24, 2016

(30) Foreign Application Priority Data

Sep. 22, 2014 (JP) ..... 2014-193159

(51) Int. Cl.
*G10H 7/00* (2006.01)
*G10H 1/00* (2006.01)

(52) U.S. Cl.
CPC ..... *G10H 1/0066* (2013.01); *G10H 2210/241* (2013.01)

(58) Field of Classification Search
CPC ..... G10H 1/0066; G10H 2210/241
USPC ..... 84/602
See application file for complete search history.

(56) References Cited

U.S. PATENT DOCUMENTS

2007/0021152 A1* 1/2007 Jung ..... G06F 3/0362 455/564
2007/0270986 A1* 11/2007 Mizoguchi ..... G11B 19/02 700/94
2008/0013756 A1* 1/2008 Roman ..... G11B 19/022 381/119
2010/0128585 A1* 5/2010 Kudo ..... G10H 1/0091 369/47.15
2013/0123961 A1* 5/2013 Roman ..... G10H 1/0008 700/94

FOREIGN PATENT DOCUMENTS

JP 09090955 A 4/1997
JP 09090958 A 4/1997
JP 11144394 A 5/1999
JP 2010231027 A 10/2010
JP 2012098482 A 5/2012
WO 2006104108 A1 10/2006

OTHER PUBLICATIONS

Japanese Office Action (and English translation thereof) dated Dec. 1, 2015, issued in counterpart Japanese Application No. 2014-193159.

* cited by examiner

*Primary Examiner* — Jeffrey Donels
(74) *Attorney, Agent, or Firm* — Holtz, Holtz & Volek PC

(57) ABSTRACT

A musical sound control apparatus (1) includes a slider (17*a*), a CPU (11) and a recording ring buffer (13*a*). The slider (17*a*) enables scratching in both directions. The CPU (11) plays back musical sound data being sequentially supplied. The recording ring buffer (13*a*) rapidly stores, in response to emit a sound of the musical sound data being supplied, the musical sound data. The CPU (11), in a case of a scratch operation being performed on the slider (17*a*), controls so as to read out and playback the musical sound data stored in the recording ring buffer (13*a*) in place of the musical sound data being supplied, based on a direction and operation speed of the scratch operation.

11 Claims, 16 Drawing Sheets

MUSICAL SOUND CONTROL APPARATUS, MUSICAL SOUND CONTROL METHOD, PROGRAM STORAGE MEDIUM AND ELECTRONIC MUSICAL INSTRUMENT

This application is based upon and claims the benefit of priority from the prior Japanese Patent Application No. 2014-193159, filed Sep. 22, 2014, and the entire contents of which are incorporated herein by reference.

BACKGROUND OF THE INVENTION

1. Field of the Invention

The present invention relates to a musical sounds control apparatus, a musical sound control method, a program storage medium and an electronic musical instrument.

2. Related Art

Conventionally, a so-called turn-table/DJ mixer that plays back musical sound recorded on a record has been known.

With a turntable/DJ mixer, it is possible to perform a scratch operation to cause a record to advance and reverse in the rotational direction to cause to repetitively playback musical sound recorded on the same portion.

In addition, technology for realizing the function of the scratch operation of such a turntable/DJ mixer by way of electronic processing is being developed.

For example, with the scratch reproducing device described in Japanese Unexamined Patent Application, Publication No. H11-144394, in the case of generating musical sound by way of a scratch operation on a digital disc such as a CD or DVD, it is configured so as to record the musical time data representing the musical time of the audio data on the disk, and use the musical time data to perform scratch reproduction.

SUMMARY OF THE INVENTION

However, without using a medium on which musical sound is recorded such as a record and digital disc, in the case of realizing the function of a scratch operation using musical sound inputted in real time by way of external input, a live musical performance, or the like, it has not been possible to realize the function of a scratch operation similarly to a case of using media on which musical sound is recorded. For example, in the case of musical sound being inputted in real time, musical sound ahead of the current playback position (future) has not been inputted yet; therefore, it is not possible to utilize in the scratch operation.

In other words, with the conventional technology, there has been a problem in appropriately playing back musical sound being inputted in real time to handle a scratch operation.

The present invention has been made by taking account of such a situation, and has an object of more appropriately playing back musical sound being inputted in real time to correspond to a scratch operation.

In order to achieve the above-mentioned object, a musical sound control apparatus of an aspect of the present invention includes:

- an operator that enables a scratch operation in both directions;
- a storage unit that rapidly stores, in response to emit a sound of an external musical sound data being supplied externally, the external musical sound data;
- a playback control unit that controls musical sound data stored in the storage unit, which is at least one of items of the external musical sound data, so as to read out and playback the musical sound data, in place of another of items of the external musical sound data which are not stored in the storage unit, based on the scratch operation performed in at least one direction of the both directions.

DETAILED DESCRIPTION OF THE INVENTION

Hereinafter, embodiments of the present invention will be explained using the drawings.

First Embodiment

Configuration

Figure 1:
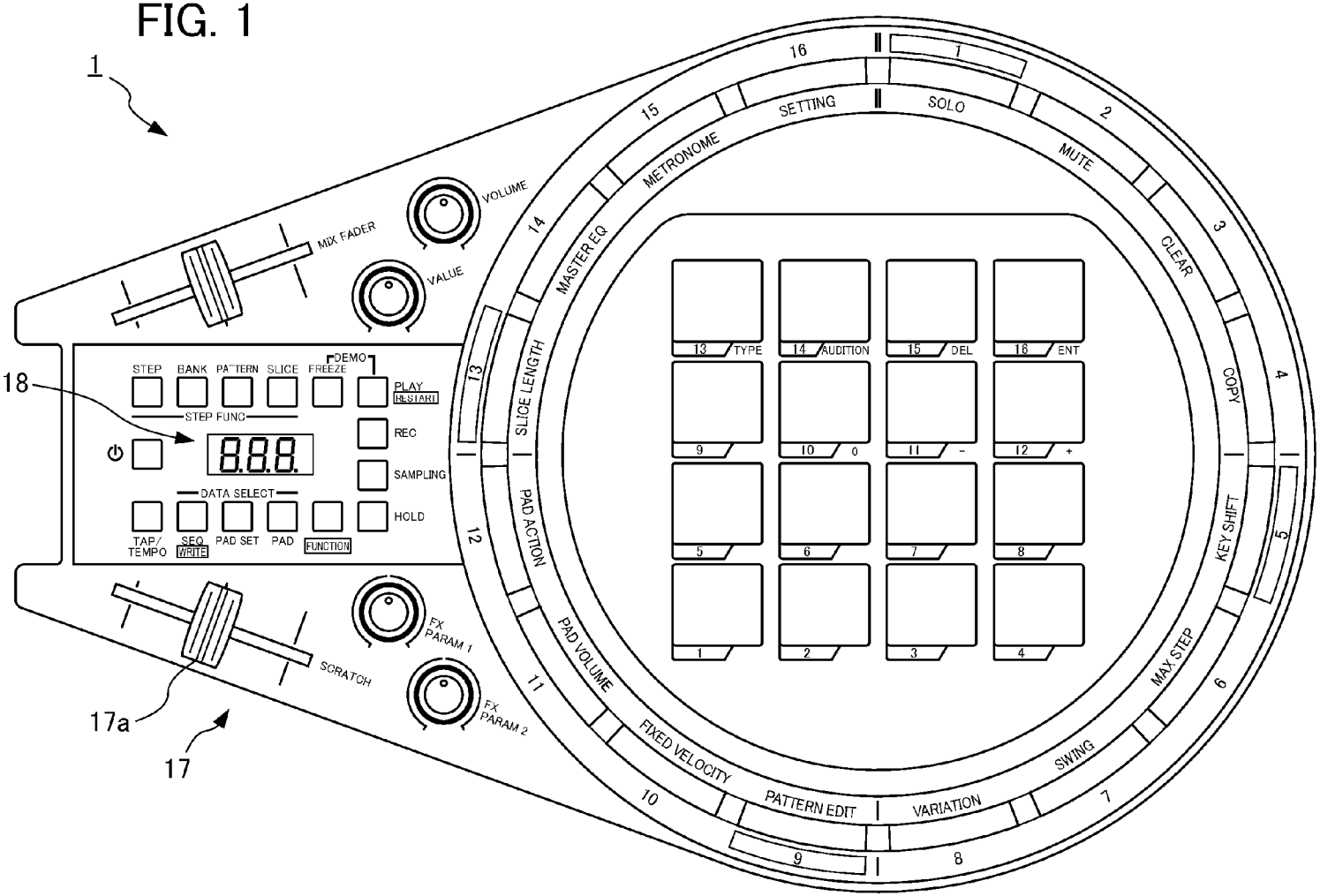
FIG. 1 is a schematic view showing an external configuration of a musical sound control apparatus according to a first embodiment of the present invention.
Figure 2:
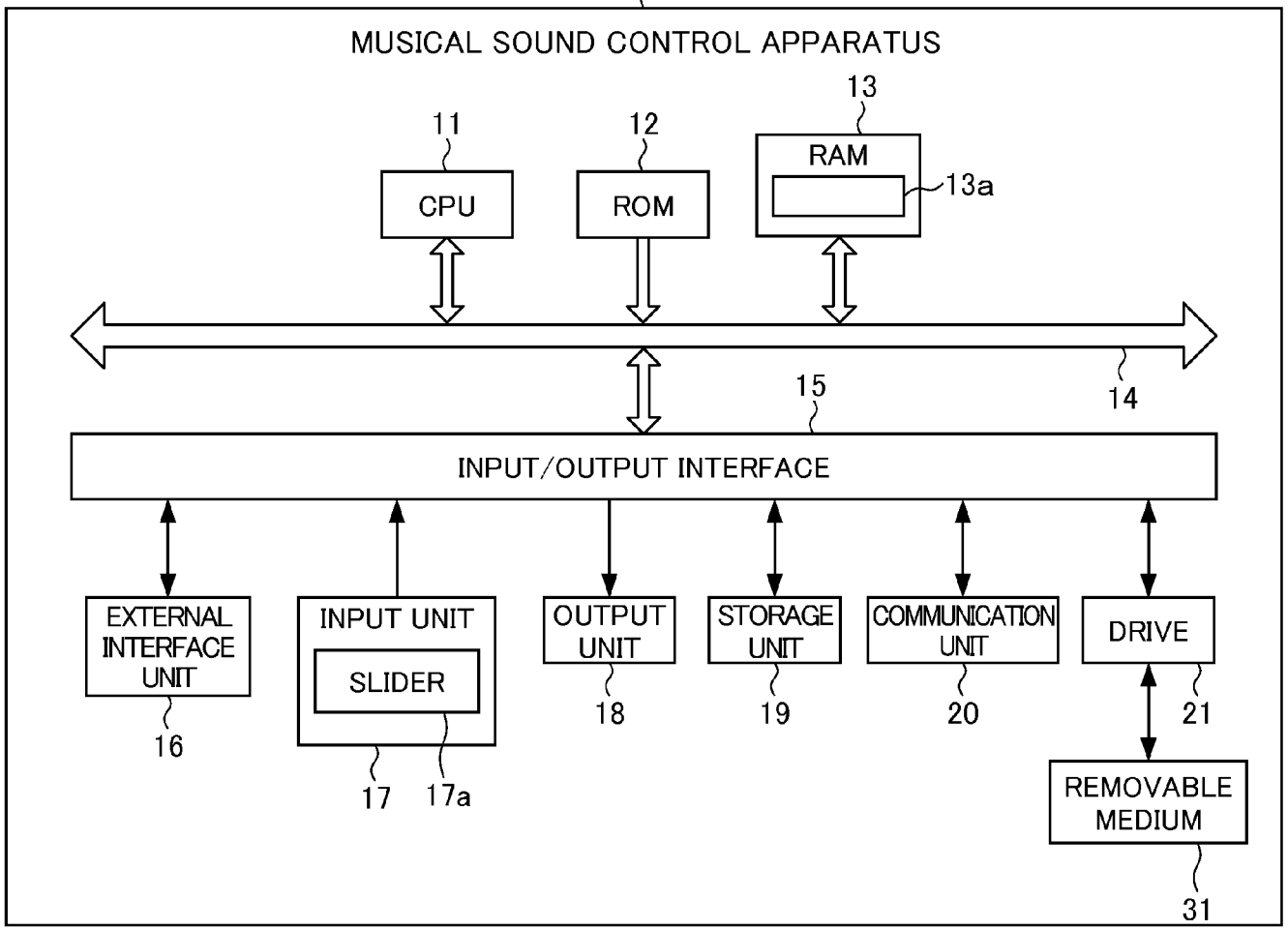
FIG. 2 is a block diagram showing a hardware configuration of the musical sound control apparatus according to the first embodiment of the present invention.

FIG. 1 is a schematic diagram showing the external configuration of a musical sound control apparatus 1 according to a first embodiment of the present invention. FIG. 2 is a block diagram showing the hardware configuration of the musical sound control apparatus 1 according to the first embodiment of the present invention.

The musical sound control apparatus 1 is an electronic device realizing the functions of a so-called turntable/DJ mixer, which performs a scratch operation and adds effects to musical sound, for example, by way of electronic processing. Herein, scratch operation refers to an operation of causing a record to advance in the rotational direction to cause the musical sound recorded on the same portion to be played back repetitively. In the present invention, the generation of musical sound imitating a case of a scratch operation being performed on a record is realized by electronic processing.

The musical sound control apparatus 1 includes a CPU (Central Processing Unit) 11, ROM (Read Only Memory) 12, RAM (Random Access Memory) 13, a bus 14, an input/output interface 15, an external interface unit 16, an input unit 17, an output unit 18, a storage unit 19, a communication unit 20, and a drive 21.

The CPU (playback control unit) 11 executes various kinds of processing according to programs stored in the ROM 12 or programs loaded from the storage unit 19 into the RAM 13.

The RAM 13 appropriately stores data, etc. that is necessary for the CPU 11 to execute various kinds of processing (for example, a flag indicating that a scratch effect described later is in operation, etc.). A recording ring buffer 13*a* is provided in a region of the RAM 13. The recording ring buffer 13*a* cyclically stores the data for a set time duration (e.g., 4 to 5 seconds) of the musical sound inputted to the musical sound control apparatus 1. More specifically, data of the peak values of musical sound encoded by PCM (Pulse Code Modulation), etc. is stored in the recording ring buffer 13*a*.

The CPU 11, ROM 12 and RAM 13 are connected with each other via the bus 14. To this bus 14 is also connected the input/output interface 15. To the input/output interface 15 is connected the external interface unit 16, the input unit 17, the output unit 18, the storage unit 19, the communication unit 20, and the drive 21.

The external interface unit 16 includes an input/output port such as USB (Universal Serial Bus) and MIDI (Musical Instrument Digital Interface), and controls the input and output of signals via an external apparatus. The data (external musical sound data) of real-time musical sound from an external apparatus is inputted via the external interface unit 16.

The input unit 17 is configured by rotational operators (knobs), sliders, buttons, pads, etc., and inputs various information in response to the instruction operations of the user. More specifically, the input unit 17 includes sliders 17*a* that accept the input of a slide operation. The slider 17*a* is an operator that is reciprocally movable in a linear manner in a plus direction (e.g., right direction in FIG. 1) and minus direction (e.g., left direction in FIG. 1) from a reference position. The operation to cause the slider 17*a* to move from the reference position in the plus direction corresponds to a scratching operation to cause the record on the turntable to rotate in the forward direction (forward scratch operation), and the operation to cause the slider 17*a* to move from the reference position in the minus direction corresponds to a scratching operation to cause the record on the turntable to rotate in the opposite direction (opposite direction scratch operation).

When an operation to cause the slider 17*a* to move in the plus direction or minus direction is performed, musical sound corresponding to the scratch operation in the forward direction or opposite direction is generated following the scratch effect interrupt processing described later. In other words, the user can input an operation corresponding to a scratch operation on the record on a turntable by repeating a movement operation in the plus direction and minus direction on the slider 17*a*.

The output unit 18 is configured by a display, speakers, etc., and outputs images and musical sound.

The storage unit 19 is configured by a hard disk, DRAM (Dynamic Random Access Memory), or the like, and stores various data that is used in the musical sound control apparatus 1.

The communication unit 20 controls the communication performed with other apparatuses (not illustrated) via a network including the Internet. The data of real-time musical sound inputted to the musical sound control apparatus 1 is able to be inputted via the communication unit 20, in addition to the external interface unit 16.

A removable medium 31 composed of a magnetic disk, an optical disk, a magnetic optical disk, semiconductor memory or the like is appropriately loaded to the drive 21. A program read from the removable medium 31 by the drive 21 is installed to the storage unit 19 as required. Furthermore, the removable medium 31 can store various data stored in the storage unit 19 in a similar way to the storage unit 19.

Operation

Next, operation of the musical sound control apparatus 1 will be explained.

Figure 3:
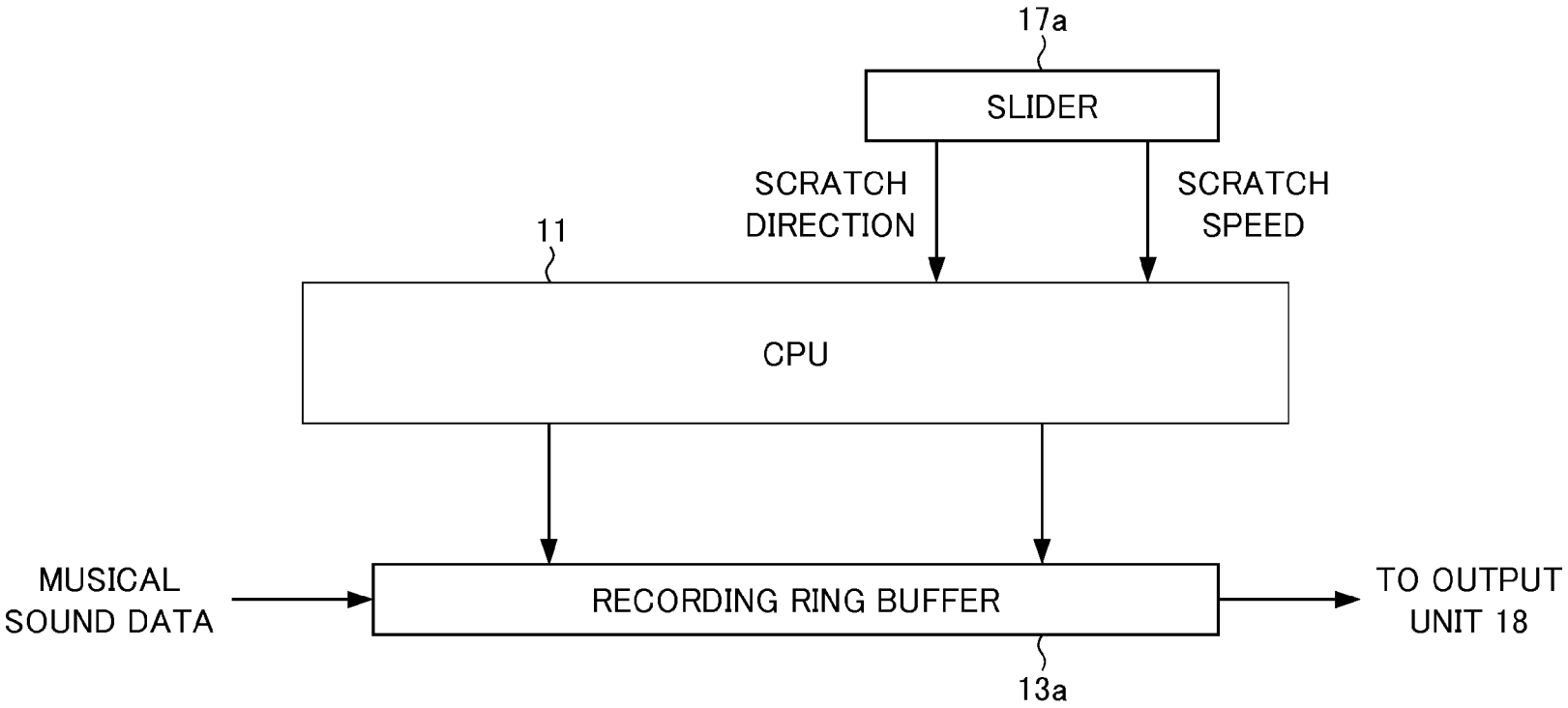
FIG. 3 is a schematic view of the musical sound control apparatus according to the present invention.

FIG. 3 is a functional block diagram in which the processing executed by the CPU (playback control unit) 11 of FIG. 2 is expressed schematically.

First, musical sound data is inputted to the musical sound control apparatus 1 via the external interface unit 16 or communication unit 20, and the CPU 11 saves the inputted musical sound data in the recording ring buffer 13*a*.

Then, when the slider 17*a* is moved by the user, the direction and speed of the scratch operation are acquired by the CPU 11, and the CPU 11 sets the playback speed corresponding to the acquired speed of the scratch operation, and sets the playback direction corresponding to the direction of the scratch operation.

The CPU 11 performs playback of the musical sound data saved in the recording ring buffer 13*a* based on the playback speed and playback direction thus set.

By configuring in this way, it is possible to add an effect according to the scratch operation into the musical sound inputted in real time.

A flowchart expressing the processing for realizing the functions shown in FIG. 3 by the CPU 11 will be explained hereinafter.

Figure 4:
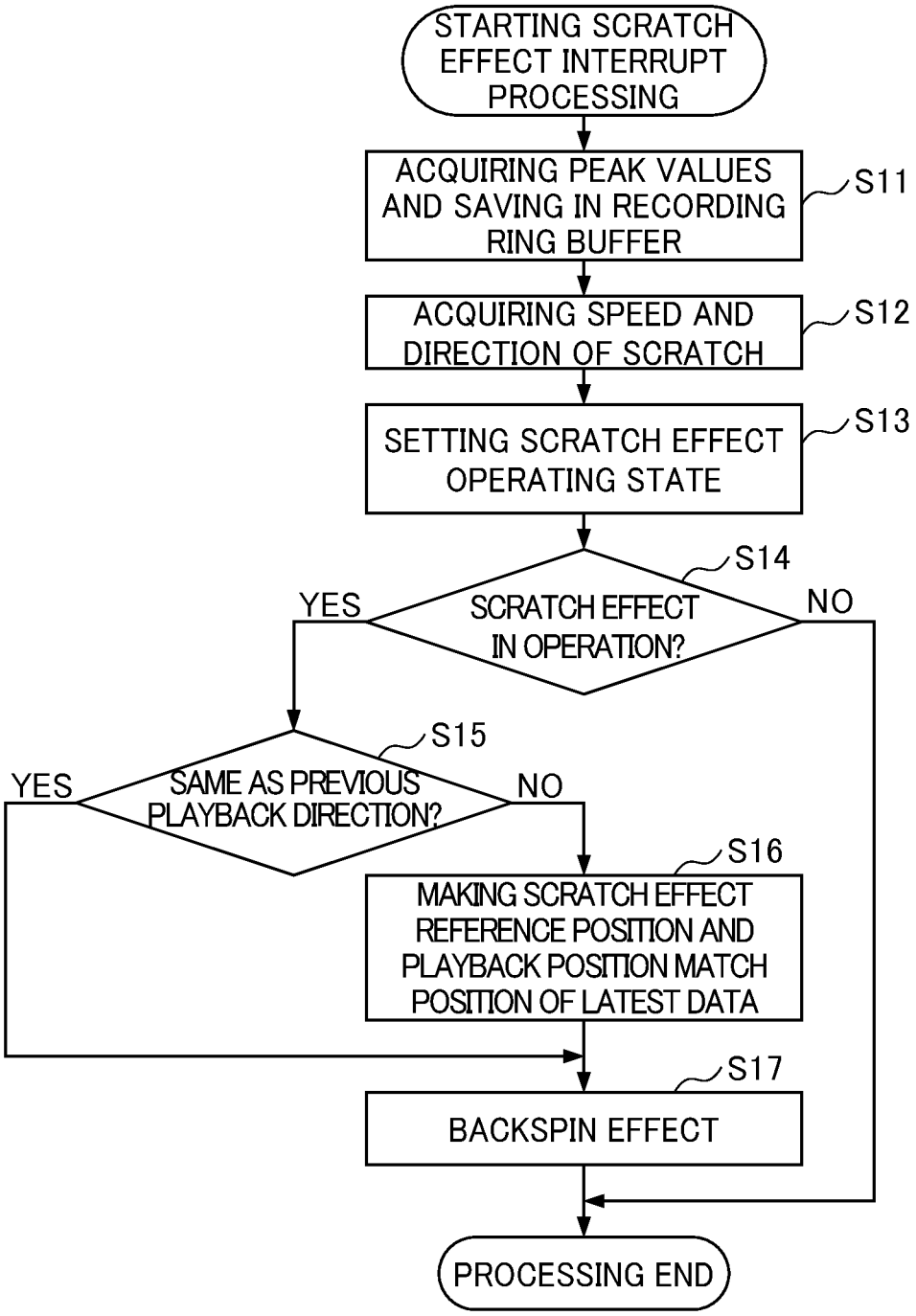
FIG. 4 is a flowchart illustrating the flow of scratch effect interrupt processing of the first embodiment.

FIG. 4 is a flowchart illustrating the scratch effect interrupt processing of the first embodiment that is executed by the CPU 11. When the slider 17*a* is moved by the user, the scratch effect interrupt processing is executed by the CPU 11.

The scratch effect interrupt processing is interrupt processing that occurs every pre-set time period, and is processing that electronically realizes the generation of musical sound imitating a case of a scratch operation being performed on a record on a turntable (hereinafter referred to as "scratch effect"), in response to a scratch operation to cause the slider 17*a* to move in the plus direction or minus direction being inputted.

In Step S11, the CPU 11 acquires the data of peak values of musical sound inputted to the musical sound control apparatus 1, and saves in the recording ring buffer 13*a*.

In Step S12, the CPU 11 acquires the speed and direction (plus direction or minus direction) of a scratch operation on the slider 17*a*.

In Step S13, the CPU 11 sets a scratch effect operating state according to the speed and direction of the scratch operation acquired in Step S12.

More specifically, the CPU 11 sets the playback speed corresponding to the speed of the scratch operation and the playback direction (forward direction or opposite direction) corresponding to the direction (plus direction or minus direction) of the scratch operation acquired in Step S12, as the scratch effect operation state.

Herein, in the present embodiment, even when the direction of the scratch operation is either of the plus direction or minus direction, the CPU 11 will set the playback direction to the opposite direction.

It is thereby possible to simply realize the generation of musical sound corresponding to the scratch operation, using the musical sound data stored in the recording ring buffer 13*a*, even in a case of the direction of the scratch operation being the plus direction.

In Step S14, the CPU 11 determines whether the scratch effect is in operation. More specifically, the CPU 11 performs determination of whether the slider 17*a* is being manipulated.

In the case of the scratch effect not being in operation, it is determined as NO in Step S14, and the processing comes to an end.

On the other hand, in the case of the scratch effect being in operation, it is determined as YES in Step S14, and the processing advances to Step S15.

In Step S15, the CPU 11 performs determination of whether the playback direction set in Step S13 is the same as the playback direction of previous scratch effect interrupt processing.

In the case of the playback direction set in Step S13 not being the same as the playback direction in the previous scratch effect interrupt processing, it is determined as NO in Step S15, and the processing advances to Step S16. It should be noted that it is determined as NO in Step S15 in the first scratch effect interrupt processing in the sequence of scratch operations.

In the case of the playback direction set in Step S13 being the same as the playback direction in the previous scratch effect interrupt processing, it is determined as YES in Step S15, and the processing advances to Step S17.

In Step S16, the CPU 11 makes the scratch effect reference position and the scratch effect playback position match the position of the latest data of the recording ring buffer 13*a* (current write address).

Herein, scratch effect reference position refers to a position on the recording ring buffer 13*a* at which starting the playback in response to a scratch operation (playback start address). On the other hand, scratch effect playback position refers to a position on the recording ring buffer 13*a* being played back in response to the scratch operation (current read address).

In Step S17, the CPU 11 plays back the musical sound data stored in the recording ring buffer 13*a* by conducting a backspin effect.

Herein, backspin effect refers to playing back musical sound data stored in the recording ring buffer 13*a* at a playback speed corresponding to the speed of the scratch operation in the order of from new data to old data (i.e. in opposite direction to normal playback direction).

After Step S17, the scratch effect interrupt processing comes to an end.

By way of such processing, in a case of a scratch operation being performed, the musical sound control apparatus 1 sets the scratch effect operating state according to the speed and direction of the scratch operation. Then, the musical sound control apparatus 1 outputs musical sound according to the backspin effect, even in a case of either scratch operation in the plus direction and minus direction.

For this reason, it is possible to generate musical sound corresponding to a scratch operation, even in a case of a scratch operation in the forward direction being performed on musical sound inputted in real time.

Therefore, it becomes possible to more appropriately playback musical sound inputted in real time to correspond to a scratch operation.

Second Embodiment

Configuration

Next, a second embodiment of the present invention will be explained.

The musical sound control apparatus 1 of the first embodiment is a configuration having the recording ring buffer 13*a* in a region of the RAM 13; whereas, the musical sound control apparatus 1 of the present embodiment has the recording ring buffer 13*a* and a playback ring buffer 13*b* in a region of the RAM 13.

Figure 5:
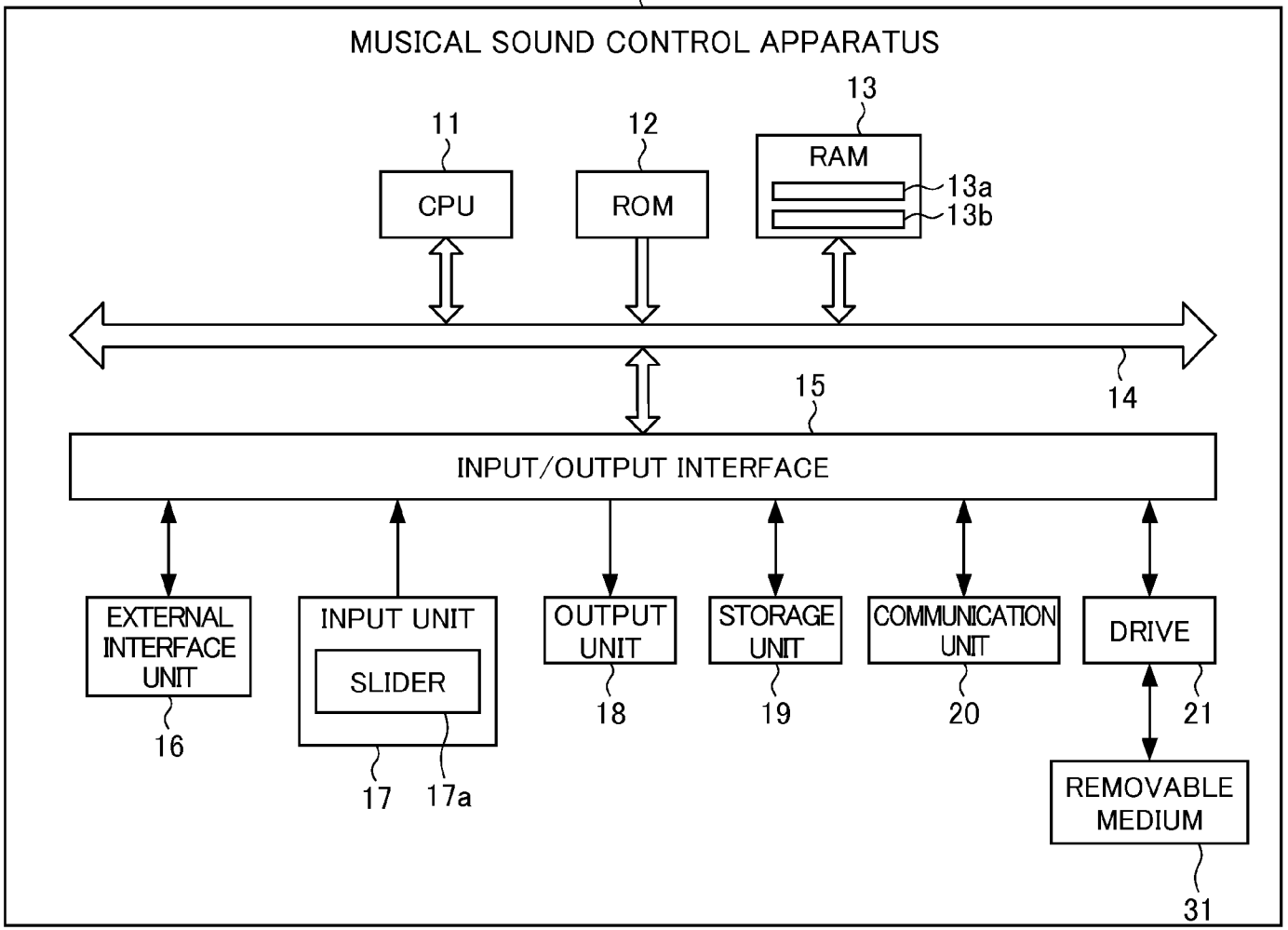
FIG. 5 is a block diagram showing a hardware configuration of a musical sound control apparatus according to a second embodiment of the present invention.

FIG. 5 is a block diagram showing the hardware configuration of the musical sound control apparatus 1 according to the second embodiment of the present invention.

In FIG. 5, the configurations of hardware other than the playback ring buffer 13*b* are similar to the configuration shown in FIG. 2 of the first embodiment.

The playback ring buffer 13*b* is a buffer for copying and retaining the musical sound data stored in the recording ring buffer 13*a*, in the case of a scratch operation being performed on the slider 17*a*.

For example, in the case of a scratch operation being performed on the slider 17*a*, it is possible to store the musical sound data stored at an address corresponding to the playback speed of the scratch operation in the recording ring buffer 13*a* sequentially every one sampling cycle into the playback ring buffer 13*b*. In addition, the processing of storing the musical sound data stored in the recording ring buffer 13*a* into the playback ring buffer 13*b* can be executed as background processing during the execution of the scratch effect interrupt processing.

Operation

Next, operation of the musical sound control apparatus 1 will be explained.

Figure 6:
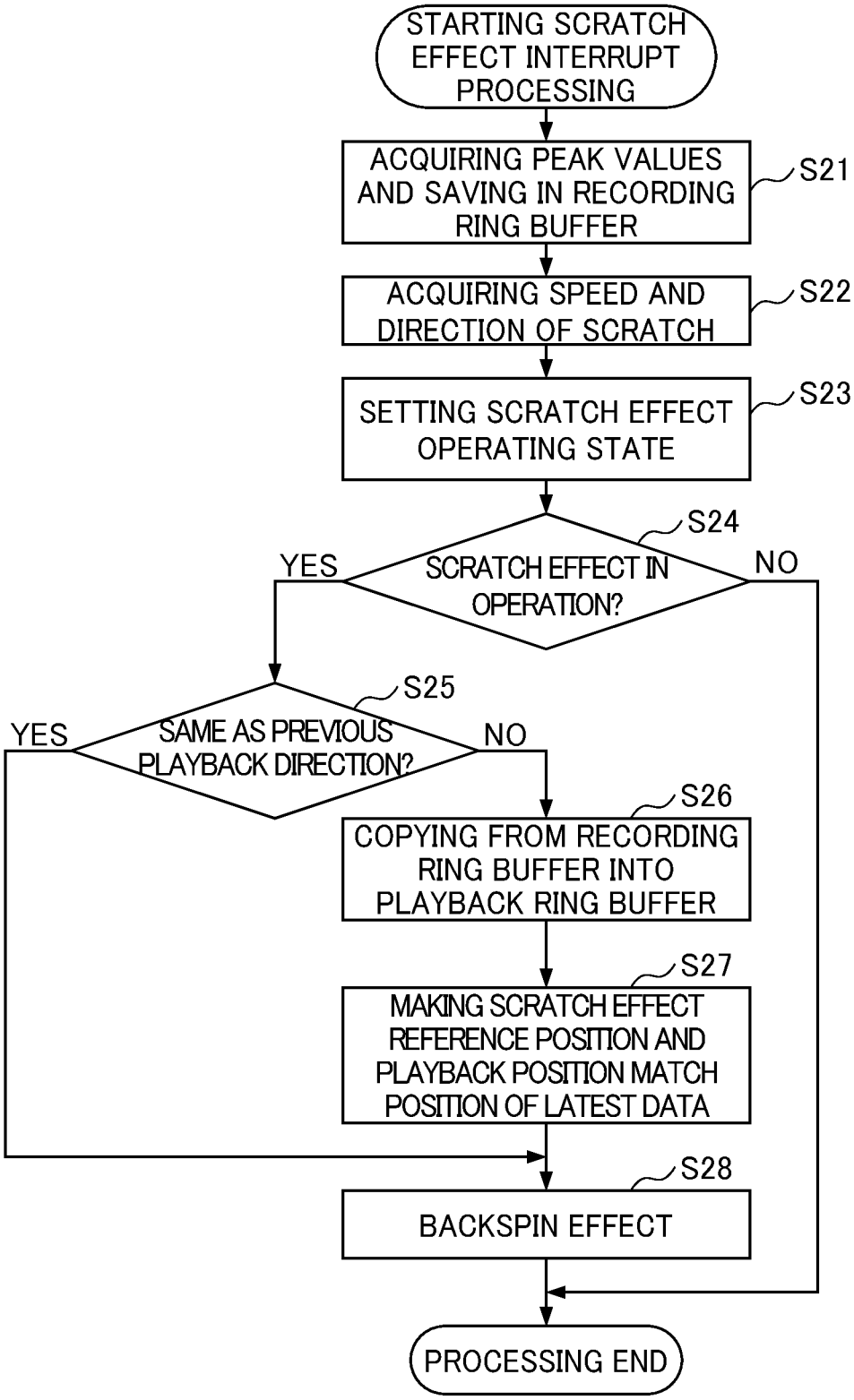
FIG. 6 is a flowchart illustrating the flow of scratch effect interrupt processing of the second embodiment.

FIG. 6 is a flowchart illustrating the flow of scratch effect interrupt processing of the second embodiment that is executed by the CPU 11.

In FIG. 6, the processing of Steps S21 to S25 is similar to the processing of Steps S11 to S15 in FIG. 4 for the first embodiment.

In the case of the playback direction set in Step S23 not being the same as the playback direction in the previous scratch effect interrupt processing, it is determined as NO in Step S25, and the processing advances to Step S26.

In Step S26, the CPU 11 copies and retains in the playback ring buffer 13*b* the musical sound data stored in the recording ring buffer 13*a*. At this time, the CPU 11 sequentially copies from the recording buffer ring 13*a* into the playback ring buffer 13*b* the data at the address corresponding to the playback speed set as the scratch effect operating state. For example, if the playback speed set as the scratch effect operating state is twice the normal playback speed, the musical sound data is copied from every other address of the recording ring buffer 13*a*.

In Step S27, the CPU 11 makes the scratch effect reference position and scratch effect playback position to match the position of the latest data of the playback ring buffer 13*b* (address at which musical sound data of the timing at which the scratch operation is performed is stored).

In Step S28, the CPU 11 plays back the musical sound data stored in the playback ring buffer 13*b* by conducting the backspin effect.

After Step S28, the scratch effect interrupt processing comes to an end.

In a case of a scratch operation being performed, the musical sound control apparatus 1 sets the scratch effect operating state according to the speed and direction of the scratch operation by way of such processing. Then, while the scratch operation of the same direction is being performed, the musical sound control apparatus 1 outputs musical sound according to the backspin effect, based on the musical sound data stored in the playback ring buffer 13*b* at the timing at which the scratch operation is performed.

For this reason, while a scratch operation in the same direction is being performed, musical sound on which the backspin effect has been conducted is outputted based on the same musical sound data; therefore, it is possible to suppress the musical sound data inputted in real time from being overwritten and changing during the scratch operation.

Therefore, it becomes possible to more appropriately playback musical sound inputted in real time to correspond to the scratch operation.

Third Embodiment

Next, a third embodiment of the present invention will be explained.

The hardware configuration of the musical sound control apparatus 1 of the present embodiment is similar to the configuration shown in FIG. 2 for the first embodiment.

Therefore, operations that are parts differing from the first embodiment will be explained mainly hereinafter.

Operation

Figure 7:
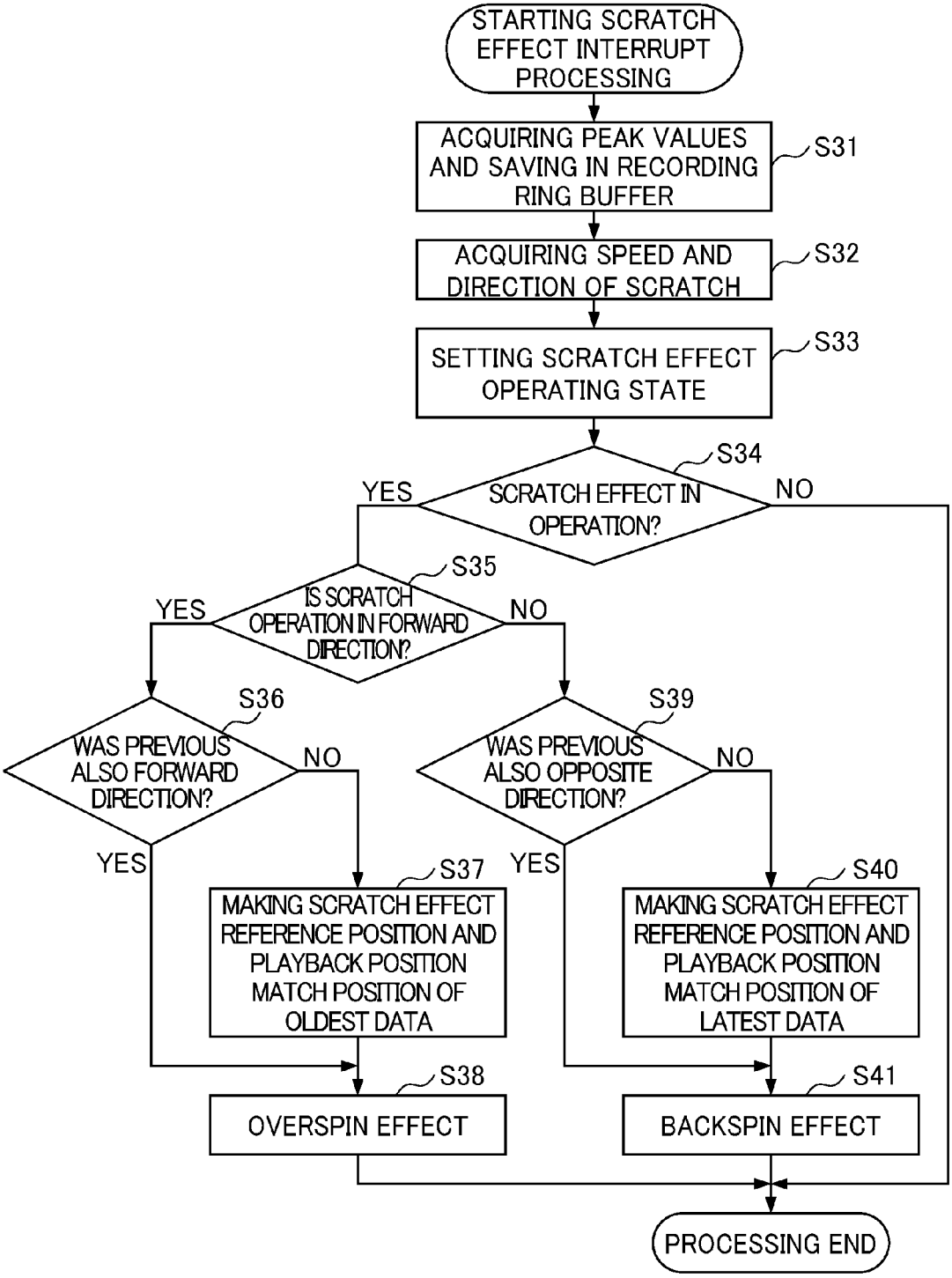
FIG. 7 is a flowchart illustrating the flow of scratch effect interrupt processing of a third embodiment.

FIG. 7 is a flowchart illustrating the flow of scratch effect interrupt processing of the third embodiment that is executed by the CPU 11.

In FIG. 7, the processing of Steps S31 to S34 is similar to the processing of Steps S11 to S14 in FIG. 4 for the first embodiment.

In Step S35, the CPU 11 performs determination of whether the direction of the scratch operation set in Step S33 is a scratch operation in the forward direction (plus direction).

In the case of the direction of the scratch operation set in Step S33 being a scratch operation in the forward direction, it is determined as YES in Step S35, and the processing advances to Step S36.

In the case of the direction of the scratch operation set in Step S33 being a scratch operation in the opposite direction, it is determined as NO in Step S35, and the processing advances to Step S39.

In Step S36, the CPU 11 performs determination of whether the playback direction of the previous scratch effect interrupt processing was the forward direction.

In the case of the playback direction of the previous scratch effect interrupt processing not being the forward direction (i.e. being the opposite direction), it is determined as NO in Step S36, and the processing advances to Step S37. It should be noted that it is determined as NO in Step S36 in the initial scratch effect interrupt processing in a sequence of scratch operations.

In the case of the playback direction in the previous scratch effect interrupt processing being the forward direction, it is determined as YES in Step S36, and the processing advances to Step S38.

In Step S37, the CPU 11 makes the scratch effect reference position and the scratch effect playback position match the position (address) of the oldest data in the recording ring buffer 13A.

It should be noted that, in Step S37, in addition to making the scratch effect reference position and scratch effect playback position match the position of the oldest data in the recording ring buffer 13*a*, it may be configured so as to make match another position (past position) set in advance.

In Step S38, the CPU 11 plays back the musical sound data stored in the recording ring buffer 13*a* by conducting overspin effect.

Herein, overspin effect refers to playing back musical sound data stored in the recording ring buffer 13*a* in order from old data to new data (i.e. same direction as the normal playback direction), at a playback speed corresponding to the speed of the scratch operation.

It should be noted that, upon playing back musical sound data by conducting the overspin effect, in the case of the scratch effect playback position catching up to the latest position (current write address) in the recording ring buffer 13*a*, it may be configured so as to return the scratch effect playback position to the scratch effect reference position or the head of the recording ring buffer 13*a*, or may be configured to be silent.

In Step S39, the CPU 11 performs determination of whether the playback direction in the previous scratch effect interrupt processing was the opposite direction.

In the case of the playback direction in the previous scratch effect interrupt processing not being the opposite direction, it is determined as NO in Step S39, and the processing advances to Step S40. It should be noted that it is determined as NO in Step S39 in the initial scratch effect interrupt processing of a sequence of scratch operations.

In the case of the playback direction for the previous scratch effect interrupt processing being the opposite direction, it is determined as YES in Step S39, and the processing advances to Step S41.

In Step S40, the CPU 11 makes the scratch effect reference position and the scratch effect playback position match the position (address) of the latest data in the recording ring buffer 13*a*.

In Step S41, the CPU 11 plays back the musical sound data stored in the recording ring buffer 13*a* by conducting the backspin effect.

After Step S38 and Step S41, the scratch effect interrupt processing comes to an end.

In the case of a scratch operation being performed, the musical sound control apparatus 1 sets the scratch effect operating state according to the speed and direction of a scratch operation by way of such processing. Then, in the case of a scratch operation in the plus direction being performed, the musical sound control apparatus 1 outputs musical sound according to the overspin effect from a past position (old data), and in the case of a scratch operation in the minus direction being performed, outputs musical sound according to the backspin effect from the latest position (latest data).

For this reason, in the case of scratch operations in the forward direction and opposite direction being performed on musical sound inputted in real time, it is possible to generate musical sound corresponding to the scratch operation.

Therefore, it becomes possible to more appropriately playback musical sound inputted in real time to correspond to a scratch operation.

Fourth Embodiment

Configuration

Next, a fourth embodiment of the present invention will be explained.

The hardware configuration of the musical sound control apparatus 1 of the present embodiment is similar to the configuration shown in FIG. 5 for the second embodiment.

Therefore, operations that are parts different from the second embodiment will be explained mainly hereinafter.

Operation

Figure 8:
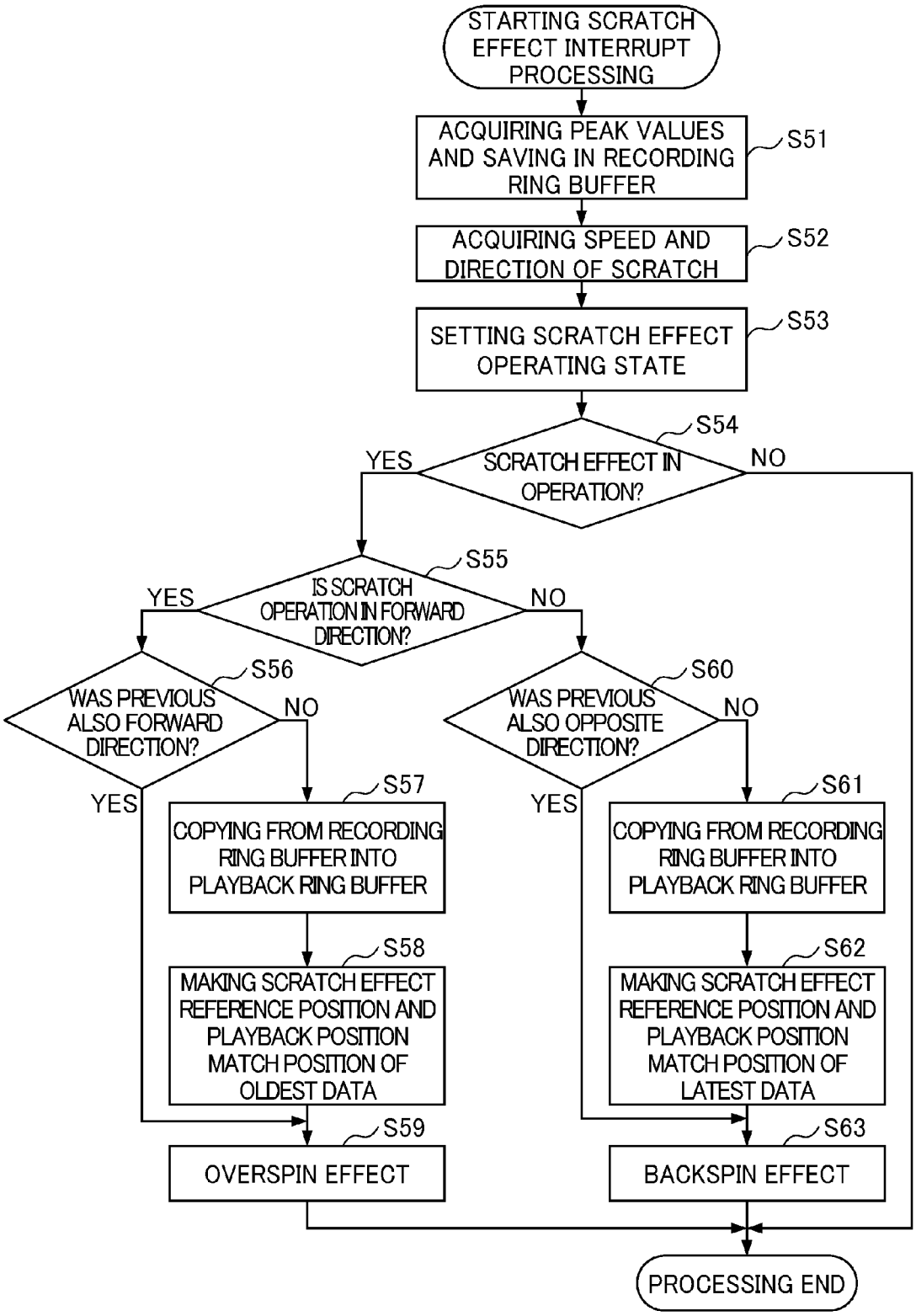
FIG. 8 is a flowchart illustrating the flow of scratch effect interrupt processing of a fourth embodiment.

FIG. 8 is a flowchart illustrating the flow of scratch effect interrupt processing of the fourth embodiment that is executed by the CPU 11.

In FIG. 8, Steps S51 to S56 and Step S60 are similar to the processing of Steps S31 to S36 and Step S39 in FIG. 7 for the third embodiment.

In Step S57, the CPU 11 copies and retains in the playback ring buffer 13*b* the musical sound data stored in the recording ring buffer 13*a*. At this time, the CPU 11 sequentially copies from the recording ring buffer 13*a* into the playback ring buffer 13*b* the data of addresses corresponding to the playback speed set as the scratch effect operating state. For example, if the playback speed set as the scratch effect operating state is twice the normal playback speed, the musical sound data will be copied from every other one address in the recording ring buffer 13*a*.

In Step S58, the CPU 11 makes the scratch effect reference position and scratch effect playback position match the position (address) of the oldest data in the recording ring buffer 13*a*.

It should be noted that, in Step S58, in addition to making the scratch effect reference position and scratch effect playback position match the position of the oldest data in the recording ring buffer 13*a*, it may be configured so as to make match another position (past position) set in advance.

In Step S59, the CPU 11 plays back the musical sound data stored in the recording ring buffer 13*a* by conducting overspin effect.

In Step S61, the CPU 11 copies and retains in the playback ring buffer 13*b* the musical sound data stored in the recording ring buffer 13*a*.

In Step S62, the CPU 11 makes the scratch effect reference position and the scratch effect playback position match the position (address) of the latest data in the recording ring buffer 13*a*.

In Step S63, the CPU 11 plays back musical sound data stored in the recording ring buffer 13*a* by conducting the backspin effect.

After Step 59 and Step S63, the scratch effect interrupt processing comes to an end.

In the case of a scratch operation being performed, the musical sound control apparatus 1 sets the scratch effect operating state according to the speed and direction of the scratch operation by way of such processing. Then, in the case of a scratch operation in the plus direction being performed, the musical sound control apparatus 1 outputs musical sound according to the overspin effect from a past position (old data), and in the case of a scratch operation in the minus direction being performed, outputs musical sound according to the backspin effect from the latest position (latest data).

For this reason, in the case of scratch operations in the forward direction and opposite direction being performed on musical sound inputted in real time, it is possible to generate musical sound corresponding to the scratch operation.

In addition, while a scratch operation in the same direction is being performed, the musical sound control apparatus 1 outputs musical sound according to the overspin effect and backspin effect, based on the musical sound data stored in the playback ring buffer 13*b* at the timing at which the scratch operation is performed.

For this reason, while a scratch operation in the same direction is being performed, since musical sound on which the overspin effect and backspin effect have been conducted is outputted based on the same musical sound data, it is possible to suppress the musical sound data inputted in real time from being overwritten and changing during the scratch operation.

Therefore, it is possible to conduct musical sound control corresponding to a scratch operation appropriately, on the musical sound generated (played back) in real time.

Fifth Embodiment

Next, a fifth embodiment of the present invention will be explained.

The hardware configuration of the musical sound control apparatus 1 of the present embodiment is similar to the configuration shown in FIG. 5 for the second embodiment.

Therefore, operations that are parts different from the second embodiment will be explained mainly hereinafter.

Operation

Figure 9:
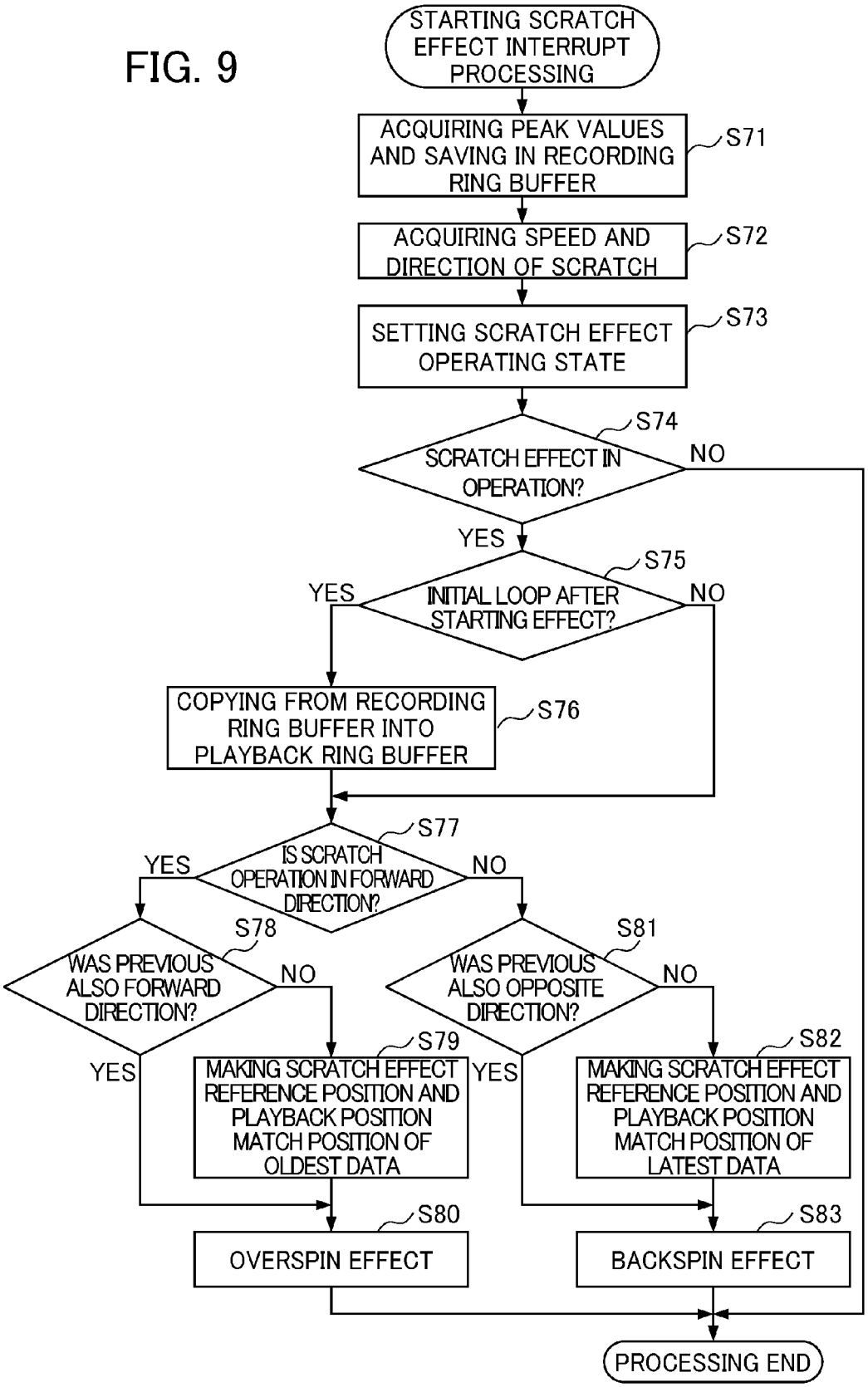
FIG. 9 is a flowchart illustrating the flow of scratch effect interrupt processing of a fifth embodiment.

FIG. 9 is a flowchart illustrating the flow of scratch effect interrupt processing of the fifth embodiment that is executed by the CPU 11.

In FIG. 9, the scratch effect interrupt processing of the present invention differs in the aspect of Step S57 and Step S61 of the scratch effect interrupt processing of the fourth embodiment not being included, while Step S75 and Step S76 are inserted.

In other words, in the scratch effect interrupt processing of the fourth embodiment, in the case of the direction of the scratch operation changing (case of changing from plus direction to minus direction, or from minus direction to plus direction), the rewriting of the playback ring buffer 13*b* is performed. In contrast, in the present embodiment, copying is done in the playback ring buffer 13*b* according to the initial scratch operation, and in the second and later scratch operations, copying is not done irrespective of the operation direction. In addition, even if the second and later scratch operations are done in the middle of copying being done according to the initial scratch operation, copying will continue so long as copying has not finished.

Step S75 and Step S76, which are parts differing from the fourth embodiment, will be explained hereinafter.

In Step S75, after being determined that the scratch effect is in operation in Step S75, the CPU 11 performs determination of whether being an initial loop in which the operation of the scratch effect was started.

In the case of being the initial loop in which the operation of the scratch effect was started, it is determined as YES in Step S75, and the processing advances to Step S76.

In the case of not being the initial loop in which the operation of the scratch effect was started, it is determined as NO in Step S75, and the processing advances to Step S77.

In Step S76, the CPU 11 copies and retains in the playback ring buffer 13*b* the musical sound data stored in the recording ring buffer 13*a*.

In the output of musical sound on which the overspin effect in Step S79 or the backspin effect in Step S82 has been conducted, the musical sound is thereby outputted based on the same musical sound data during the operation of the scratch effect.

In a case of a scratch operation being performed, the musical sound control apparatus 1 sets the scratch effect operating state according to the speed and direction of the scratch operation by way of such processing. Then, in the case of a scratch operation in the plus direction being performed, the musical sound control apparatus 1 outputs musical sound according to the overspin effect from a past position (old data), and in the case of a scratch operation in the minus direction being performed, outputs musical sound according to the backspin effect from the latest position (latest data).

For this reason, in the case of scratch operations in the forward direction and opposite direction being performed on musical sound inputted in real time, it is possible to generate musical sound corresponding to the scratch operation.

In addition, while the scratch operation is being performed, the musical sound control apparatus 1 outputs musical sound according to the overspin effect and backspin effect, based on musical sound data stored in the playback ring buffer 13*b* at the timing at which the scratch operation is performed.

For this reason, while the scratch operation is being performed, since musical sound on which the overspin effect and backspin effect have been conducted is outputted based on the same musical data, it is possible to suppress the musical sound data inputted in real time from being overwritten and changing during the scratch operation. In other words, similarly to a case of scratching an actual record on a turntable, a state is created of scratching on the same musical sound.

Therefore, it is possible to conduct musical sound control corresponding to a scratch operation appropriately, on the musical sound generated (played back) in real time.

It should be noted that, although a case of the overspin effect and backspin effect being conducted is explained in the present embodiment, it is possible to conduct musical sound control corresponding to a scratch operation appropriately on musical sound generated (played back) in real time similarly to the present embodiment, also in the case of only the backspin effect being conducted as in the second embodiment.

Sixth Embodiment

Next, a sixth embodiment of the present invention will be explained.

The hardware configuration of the musical sound control apparatus 1 of the present embodiment is similar to the configuration shown in FIG. 5 for the second embodiment.

Therefore, operations that are parts different from the second embodiment will be explained mainly hereinafter.

Operation

Figure 10:
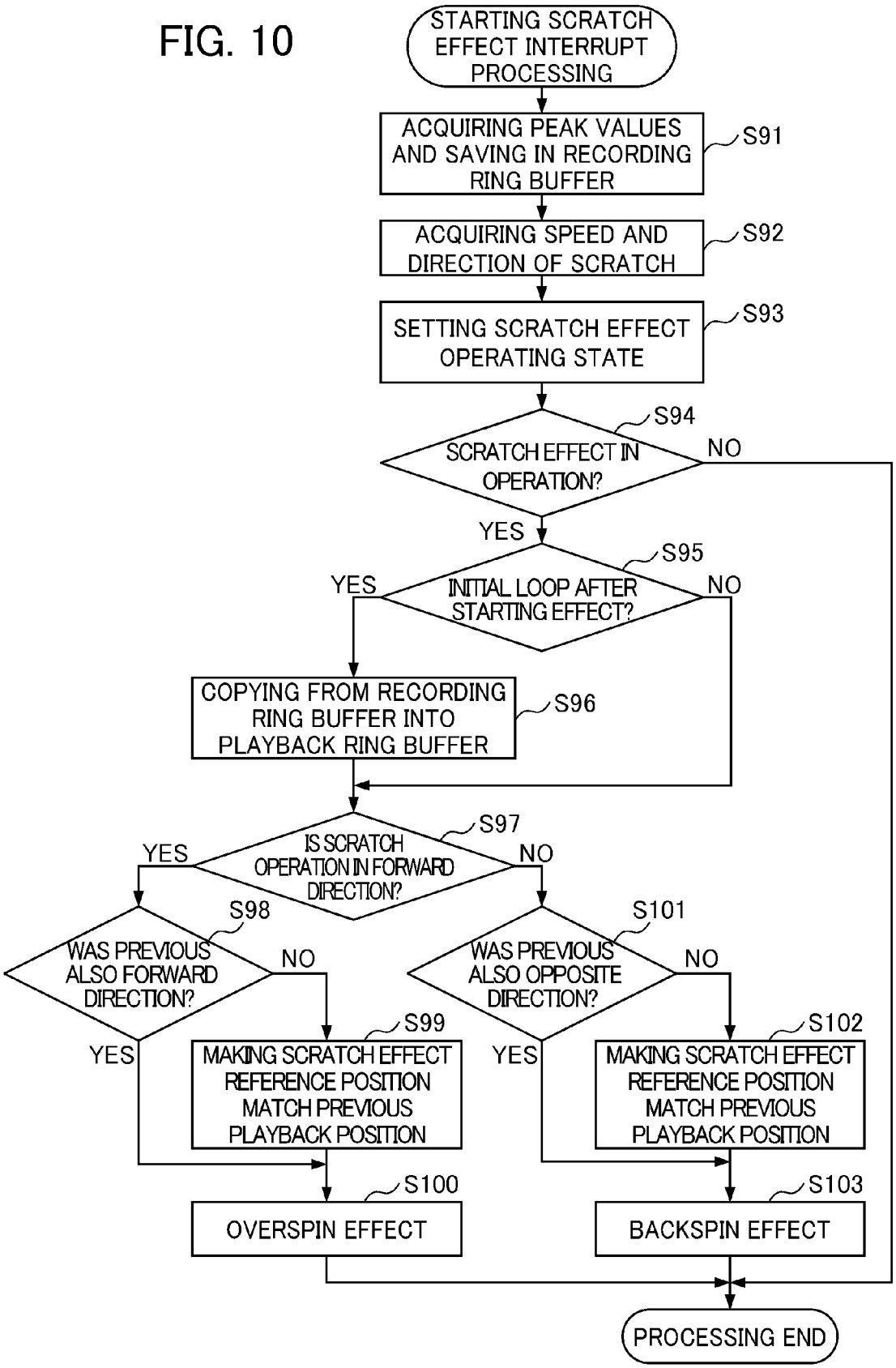
FIG. 10 is a flowchart illustrating the flow of scratch effect interrupt processing of a sixth embodiment.

FIG. 10 is a flowchart illustrating the flow of scratch effect interrupt processing of the sixth embodiment that is executed by the CPU 11.

In FIG. 10, the processing of Steps S91 to S98 and Step S101 is similar to the processing of Steps S71 to S78 and Step S81 of the fifth embodiment.

In other words, in the case of the overspin effect being conducted in the scratch effect interrupt processing of the fifth embodiment, it is configured to make the scratch effect reference position match the position of the oldest data in the playback ring buffer 13*b*, and in the case of the backspin effect being conducted, it is configured to make match the position of the latest data in the playback ring buffer 13*b*. In the present embodiment, the scratch effect reference position is made to match the previous playback position (address) in the playback ring buffer 13*b*.

Hereinafter, Step S99, Step S100, Step S102 and Step S103, which are parts differing from the fifth embodiment, will be explained.

In Step S99, the CPU 11 makes the scratch effect reference position on the playback ring buffer 13*b* and the scratch effect playback position match the scratch effect playback position on the playback ring buffer 13*b* in the previous scratch effect interrupt processing.

In other words, the scratch effect playback position of the previous scratch effect interrupt processing is maintained.

In Step S100, the CPU 11 plays back the musical sound data stored in the recording ring buffer 13*a* by conducting the overspin effect.

In Step S102, the CPU 11 makes the scratch effect reference position and scratch effect playback position on the playback ring buffer 13*b* match the scratch effect playback position on the playback ring buffer 13*b* in the previous scratch effect interrupt processing.

In other words, the scratch effect playback position of the previous scratch effect interrupt processing is maintained.

In Step S103, the CPU 11 plays back the musical sound data stored in the recording ring buffer 13*a* by conducting the backspin effect.

By way of such processing, in a case of a scratch operation being performed, the musical sound control apparatus 1 sets the scratch effect operating state according to the speed and direction of the scratch operation. Then, in the case of a scratch operation in the plus direction being performed, the musical sound control apparatus 1 outputs musical sound according to the overspin effect from a past position (old data), and in the case of a scratch operation in the minus direction being performed, outputs musical sound according to the backspin effect from the latest position (latest data).

For this reason, in the case of scratch operations in the forward direction and opposite direction being performed on musical sound inputted in real time, it is possible to generate musical sound corresponding to the scratch operation.

In addition, while the scratch operation is being performed, the musical sound control apparatus 1 outputs musical sound according to the overspin effect and backspin effect, based on musical sound data stored in the playback ring buffer 13*b* at the timing at which the scratch operation is performed.

For this reason, while the scratch operation is being performed, since musical sound on which the overspin effect and backspin effect have been conducted is outputted based on the same musical data, it is possible to suppress the musical sound data inputted in real time from being overwritten and changing during the scratch operation. In other words, similarly to a case of scratching an actual record on a turntable, a state is created of scratching on the same musical sound.

In addition, while a scratch operation is being performed, the musical sound control apparatus 1 maintains the scratch effect playback position of the previous scratch effect interrupt processing, and outputs musical sound on which the overspin effect and backspin effect have been conducted.

For this reason, in the case of a scratch operation in the forward direction and a scratch operation in the opposite direction being repeated, it is possible to perform a natural scratch effect.

Therefore, it is possible to conduct musical sound control corresponding to a scratch operation appropriately, on the musical sound generated (played back) in real time.

Seventh Embodiment

Next, a seventh embodiment of the present invention will be explained.

The hardware configuration of the musical sound control apparatus 1 of the present embodiment is similar to the configuration shown in FIG. 5 for the second embodiment.

Therefore, operations that are parts different from the second embodiment will be explained mainly hereinafter.

Operation

Figure 11:
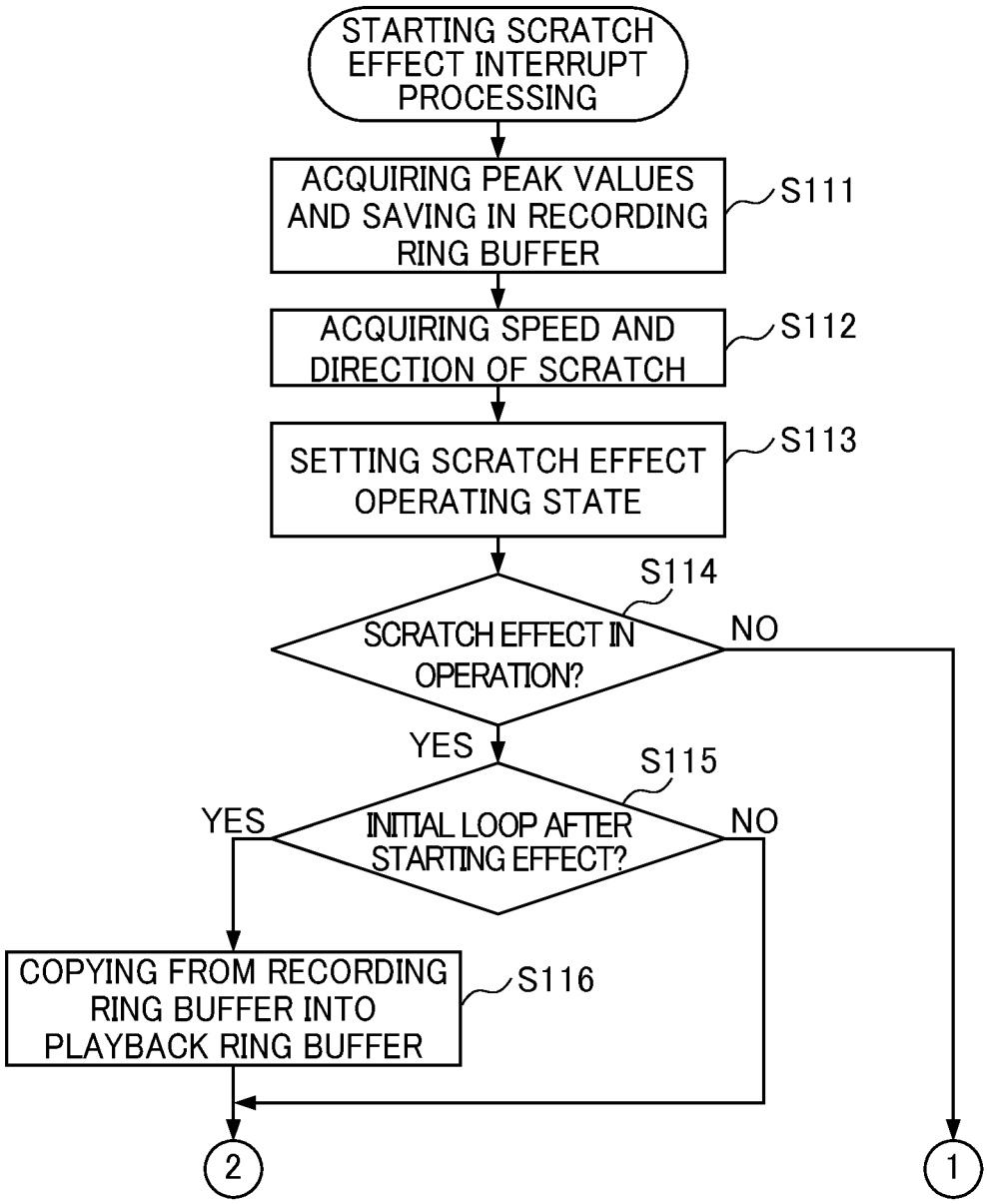
FIG. 11 is a flowchart illustrating the flow of scratch effect interrupt processing of a seventh embodiment.
Figure 12:
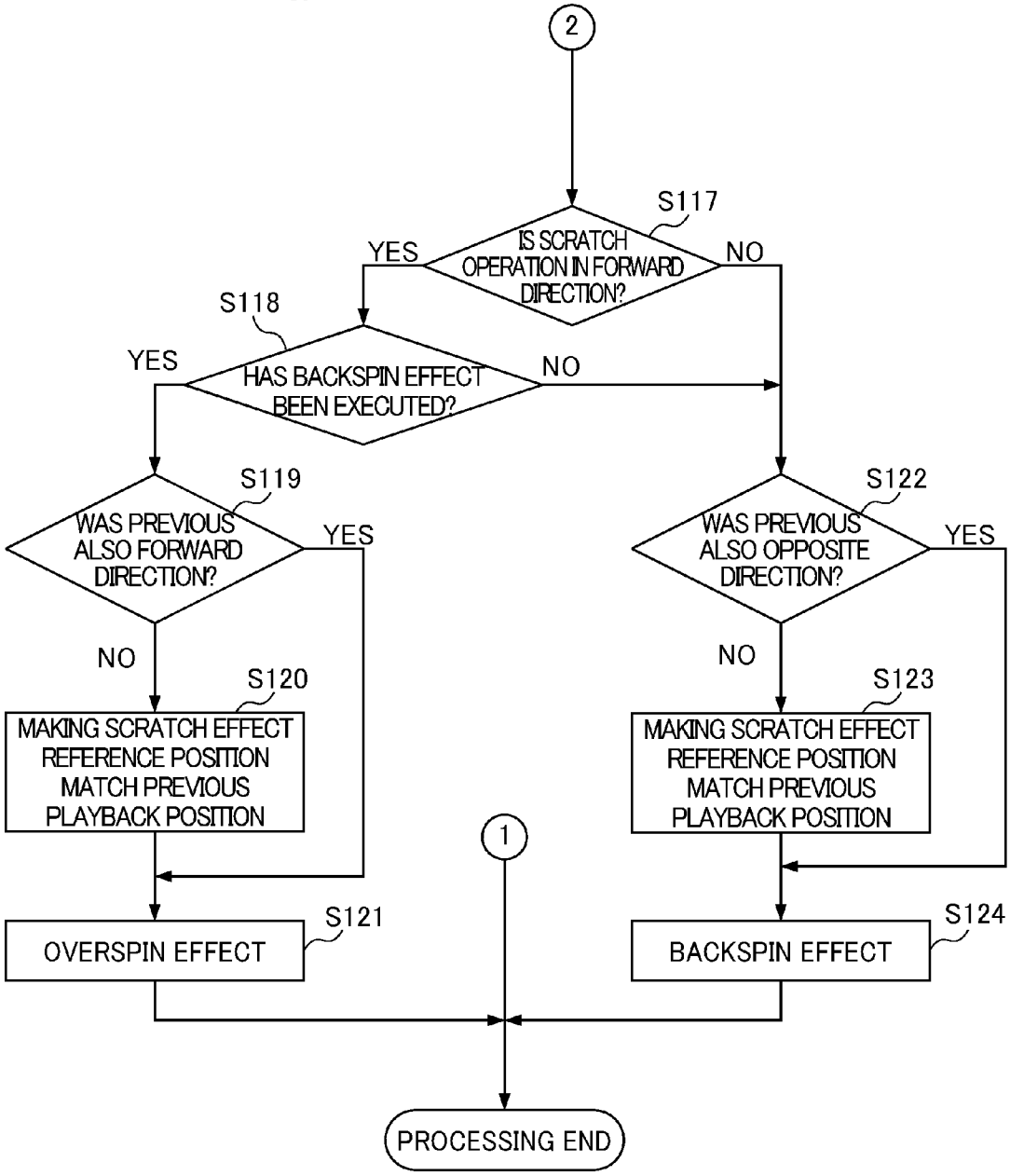
FIG. 12 is a flowchart illustrating the flow of scratch effect interrupt processing of a seventh embodiment.

FIGS. 11 and 12 are flowcharts illustrating the flow of scratch effect interrupt processing of the seventh embodiment that is executed by the CPU 11.

In FIGS. 11 and 12, the scratch effect interrupt processing of the present embodiment is similar to the scratch effect interrupt processing of the sixth embodiment, excluding the processing of Step S118.

In other words, in the case of a scratch operation being performed, with the scratch effect interrupt processing of the sixth embodiment, the backspin effect is conducted first, and thereafter, the scratch effect is conducted in the playback direction according to the direction of the scratch operation.

Hereinafter, Step S118, which is a part differing from the sixth embodiment, will be explained.

In the case of the direction of the scratch operation being a scratch operation in the forward direction, it is determined as YES in Step S117, and the processing advances to Step S118.

In Step S118, the CPU 11 performs determination of whether the musical sound data is being played back by conducting the backspin effect after determined as being in scratch effect operation in Step S114 and the CPU 11 started the scratch effect. In other words, it is determined whether the backspin effect to be initially executed has already been executed after starting the scratch effect operation.

In the case that the musical sound data is being played back by conducting the backspin effect after determined as being in scratch effect operation in Step S114 and the CPU 11 started the scratch effect, it is determined as YES in Step S118, and the processing advances to Step S119.

In the case that the musical sound data is not being played back by conducting the backspin effect after determined as being in scratch effect operation in Step S114 and the CPU 11 started the scratch effect, it is determined as NO in Step S118, and the processing advances to Step S122.

In other words, even if determined as being a scratch operation in the forward direction in Step S117, in the case of having determined that the backspin effect to be executed initially has not been executed, the backspin effect will be performed.

In the case of a scratch operation being performed, it is thereby possible to avoid a situation such as becoming silent immediately after the scratch operation, because the backspin effect is executed without exception.

It should be noted that, in the case of determining whether being a scratch operation in the forward direction in Step S117, the data volume of musical sound in the forward direction stored in the playback ring buffer 13*b* may be further determined, and it may be decided whether to execute the overspin effect. In other words, even if the backspin effect to be executed initially has been executed after the scratch operation, in the case of the data volume of musical sound in the forward direction relative to the current playback position not being sufficient, since the playback time according to a forward direction effect cannot be sufficiently ensured, it may be configured to further executed the opposite direction effect.

In the case of a scratch operation being performed, the musical sound control apparatus 1 executes the backspin effect initially, and thereafter, executes a scratch effect in the playback direction according to the direction of the scratch operation by way of such processing.

In the case of a scratch operation in the plus direction being performed, although musical sound is outputted according to the overspin effect from a past position (old data), in this case, since the playback position suddenly jumps to a past position, a scratch effect like that of a turntable/DJ mixer cannot be realized. In addition, in the case of a scratch operation in the plus direction being performed, when making the scratch reference position to be the latest position (latest data), since the data more in the future than the latest position does not exist, processing such as to make silent is necessary. In order to avoid this silence, in the seventh embodiment, it is configured to execute the backspin effect for both the scratch operation in the forward direction and the scratch operation in the opposite direction.

In the case of a scratch operation being performed, it is thereby possible to avoid a situation such as the aforementioned becoming silent (muting) immediately after the scratch operation, because the backspin effect is executed without exception.

Therefore, it is possible to make musical sound control corresponding to a scratch operation appropriately, on the musical sound generated (played back) in real time.

It should be noted that, in the second and later scratch operations, the scratch effect may be executed in the playback direction that is the opposite direction to the direction of the scratch operation. For example, in the case of performing scratch operations in the order of a scratch operation in the forward direction, a scratch operation in the opposite direction and a scratch operation in the forward direction, effects may be executed in the order of backspin effect, overspin effect and backspin effect.

Eighth Embodiment

Next, an eighth embodiment of the present invention will be explained.

The hardware configuration of the musical sound control apparatus 1 of the present embodiment is similar to the configuration shown in FIG. 5 for the second embodiment.

Therefore, operations that are parts different from the second embodiment will be explained mainly hereinafter.

Operation

Figure 13:
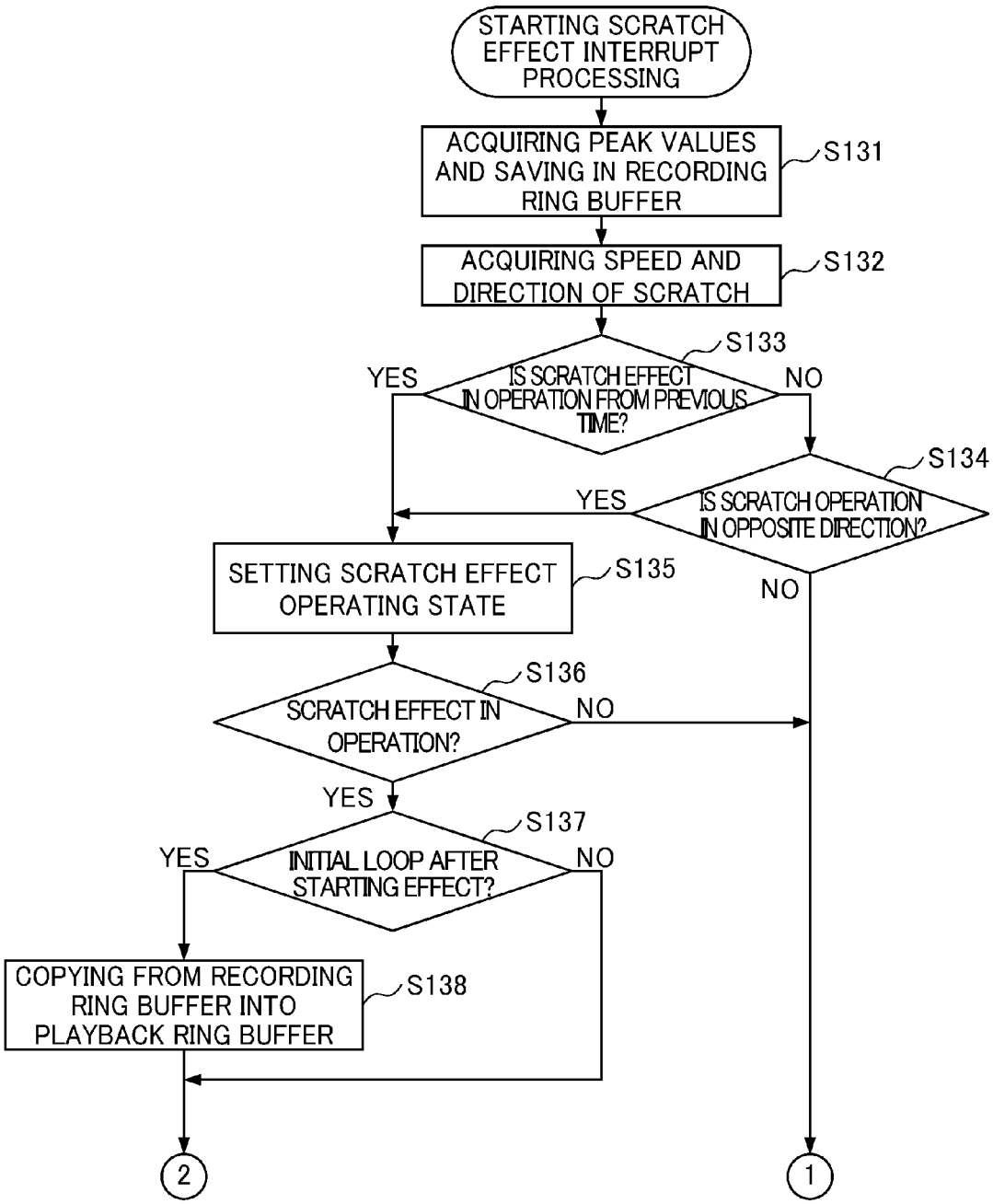
FIG. 13 is a flowchart illustrating the flow of scratch effect interrupt processing of an eighth embodiment.
Figure 14:
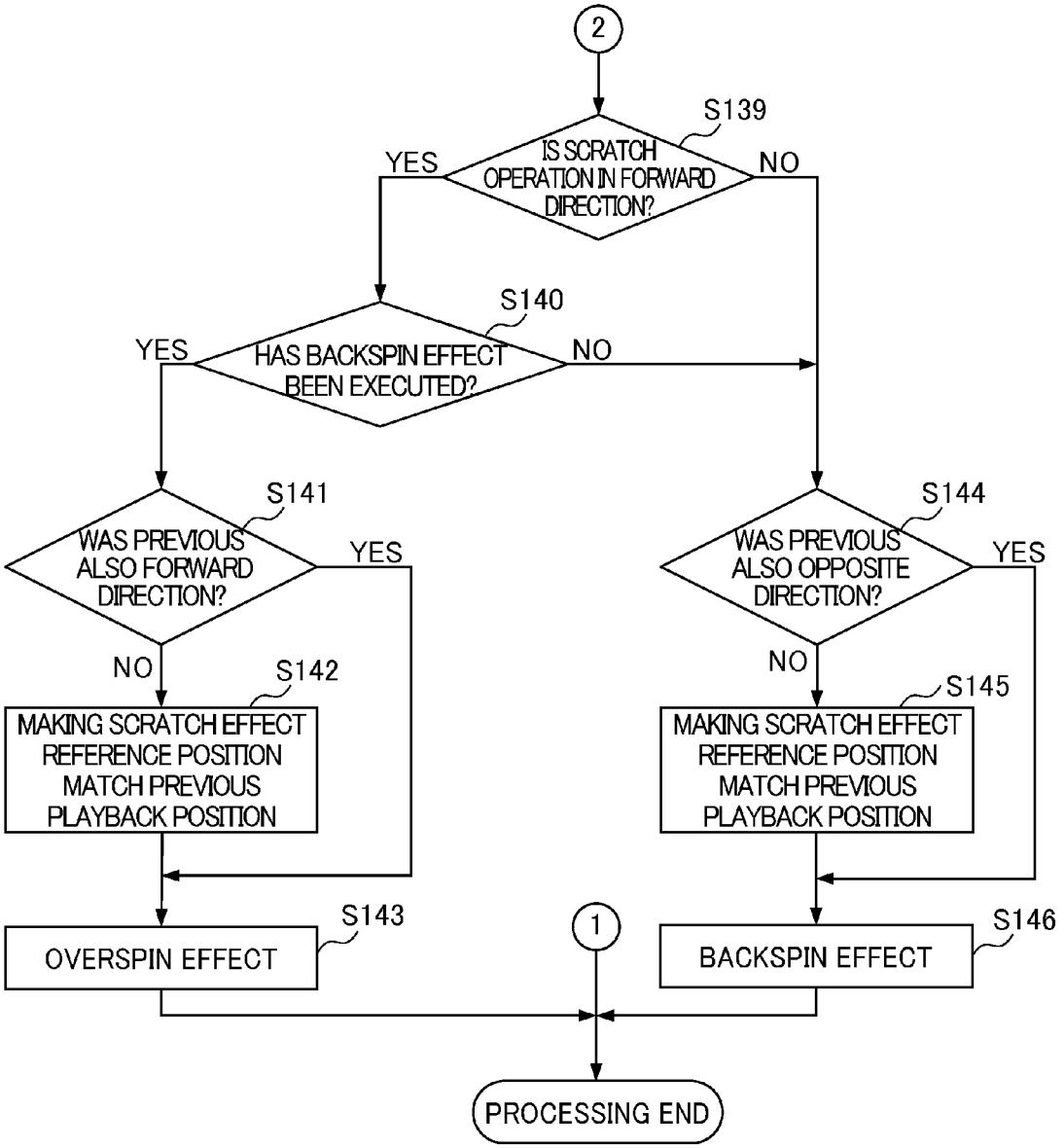
FIG. 14 is a flowchart illustrating the flow of scratch effect interrupt processing of an eighth embodiment.

FIGS. 13 and 14 are flowcharts illustrating the flow of scratch effect interrupt processing of the eighth embodiment that is executed by the CPU 11.

In the scratch effect interrupt processing of the present embodiment in FIGS. 13 and 14, the processing of Step S133 and Step S134 is added to the scratch effect interrupt processing of the seventh embodiment.

In other words, in the scratch effect interrupt processing of the present embodiment, in the case of having determined that the scratch effect from a previous loop is not in operation in Step S133 (i.e. in the case of the scratch effect operating from the present loop), the scratch effect is executed only in the case of having determined that the direction of the scratch operation is the opposite direction in Step S134, and the earlier processing is continued (e.g., continually outputting musical sound, etc.) in the case of having determined that the direction of the scratch operation is the forward direction.

Hereinafter, the processing of Step S133 and Step S134, which are parts differing from the seventh embodiment, will be explained.

In Step S133, the CPU 11 performs determination of whether the scratch effect from the previous loop is in operation.

In the case of the scratch effect from the previous loop not being in operation, it is determined as NO in Step S133, and the processing advances to Step S134.

On the other hand, in the case of the scratch effect from the previous loop being in operation, it is determined as YES in Step S133, and the processing advances to Step S135.

In Step S134, the CPU 11 performs determination of whether the direction of the scratch operation is the opposite direction.

In the case of the direction of the scratch operation not being the opposite direction (i.e. the direction of the scratch operation being the forward direction), it is determined as NO in Step S134, and the processing comes to an end.

In the case of the direction of the scratch operation being the opposite direction, it is determined as YES in Step S134, and the processing advances to Step S135.

In Step S135, the CPU 11 sets a scratch effect operating state according to the speed and direction of the scratch operation acquired in Step S132.

By way of such processing, in the case of a scratch operation being performed, if the scratch effect from the previous loop is not in operation (i.e. scratch effect being started in the present loop), the musical sound control apparatus 1 executes the scratch effect only in the case of the direction of the scratch operation being the opposite direction, and does not execute the scratch effect in the case of the direction of the scratch operation being the forward direction. It should be noted that after a scratch operation in the opposite direction has been temporarily performed, the scratch effect is executed according to the direction of the scratch operation.

It is thereby possible to avoid a situation such as muting immediately after a scratch operation.

Therefore, it is possible to conduct musical sound control corresponding to a scratch operation appropriately, on the musical sound generated (played back) in real time.

Ninth Embodiment

Next, a ninth embodiment of the present invention will be explained.

The hardware configuration of the musical sound control apparatus 1 of the present embodiment is similar to the configuration shown in FIG. 5 for the second embodiment.

Therefore, operations that are parts differing from the second embodiment will be explained mainly hereinafter.

Operation

Figure 15:
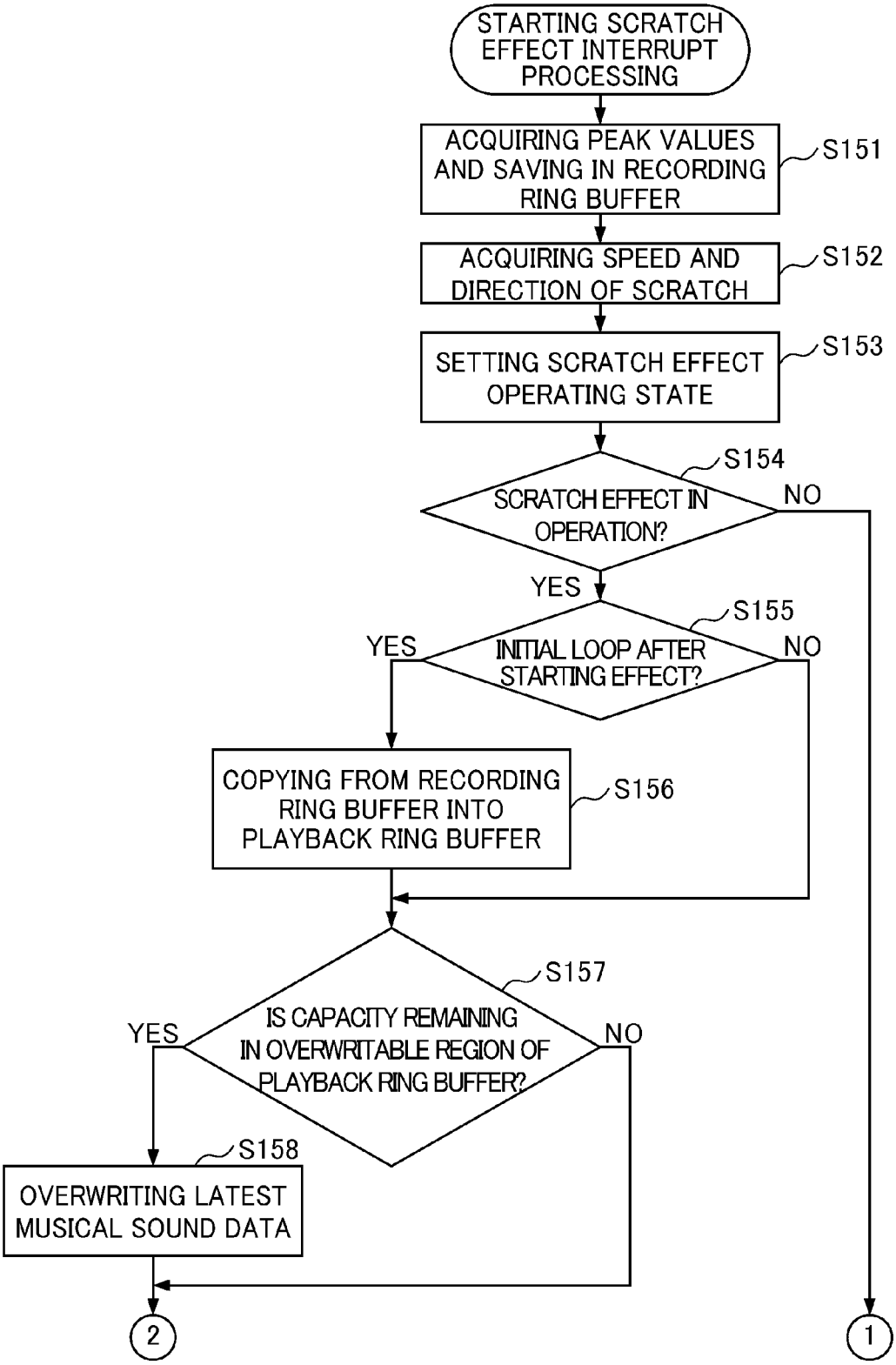
FIG. 15 is a flowchart illustrating the flow of scratch effect interrupt processing of a ninth embodiment.
Figure 16:
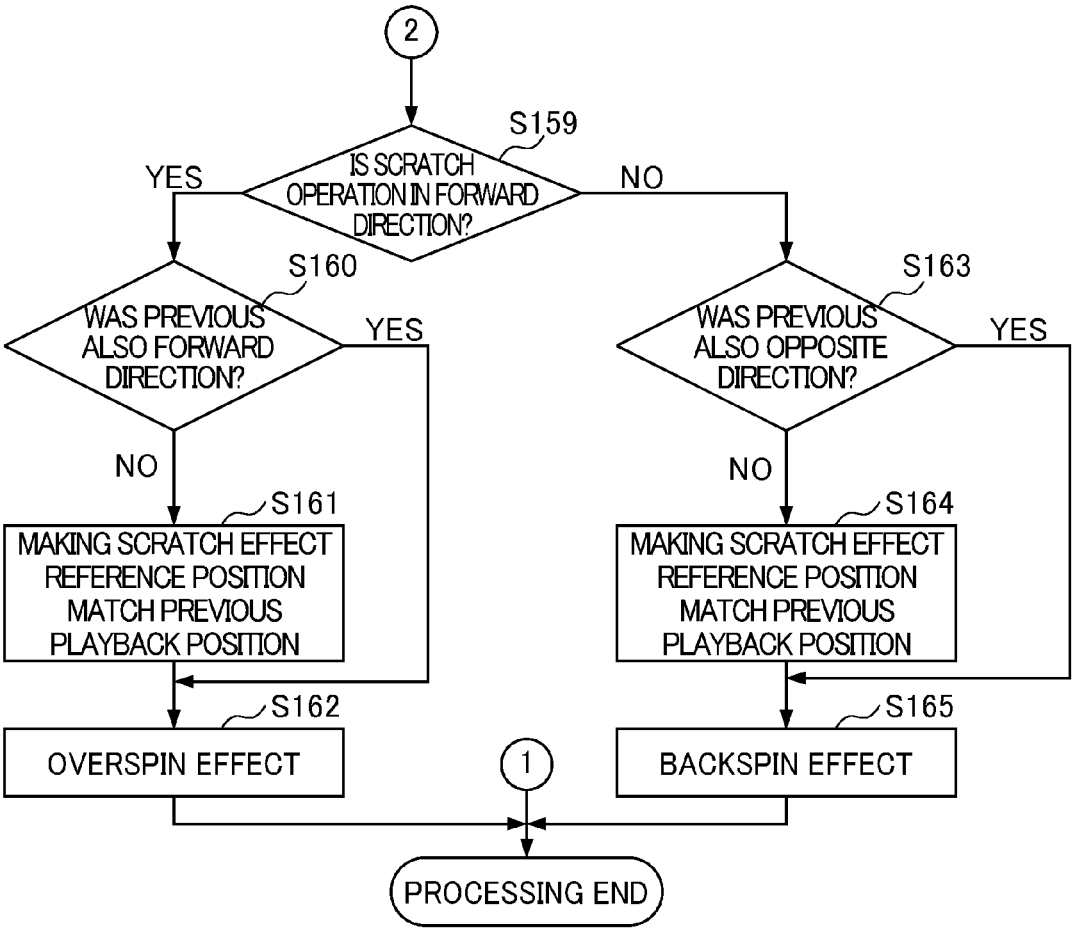
FIG. 16 is a flowchart illustrating the flow of scratch effect interrupt processing of a ninth embodiment.

FIGS. 15 and 16 are flowcharts illustrating the flow of scratch effect interrupt processing of the ninth embodiment that is executed by the CPU 11.

In the scratch effect interrupt processing of the present embodiment in FIGS. 15 and 16, the processing of Steps S156 to S158 is added to the scratch effect interrupt processing of the sixth embodiment.

In other words, with the scratch effect interrupt processing of the present embodiment, in Steps S156 to S158, after operation initiation of the scratch effect, the musical sound data is copied from the recording ring buffer 13*a* into the playback ring buffer 13*b*, and then the data of a part of a region (overwritable region described later) is overwritten with musical sound data inputted in real time.

Hereinafter, the processing of Steps S156 to S158, which are parts differing from the sixth embodiment, will be explained.

After the operation initiation of the scratch effect, in the case of being the initial loop, it is determined as YES in Step S155, and the processing advances to Step S156.

In Step S156, the CPU 11 copies and retains in the playback ring buffer 13*b* the musical sound data from the recording ring buffer 13*a*.

Herein, in the present embodiment, a partial region (e.g., 1 second amount) among the entire storage region of the playback ring buffer 13*b* is established in a region permitting overwriting (hereinafter referred to as "overwritable region").

In other words, the real-time musical sound data that is inputted during scratch effect execution is overwritten once in the overwritable region.

In Step S157, the CPU 11 performs determination of whether capacity is remaining in the overwritable region of the playback ring buffer 13*b*. In other words, in Step S157, determination is performed as to whether there is a region for which musical data has never been overwritten in the overwritable region of the playback ring buffer 13*b*.

In the case of capacity remaining in the overwritable region of the playback ring buffer 13*b*, it is determined as NO in Step S157, and the processing advances to Step S159.

In the case of capacity remaining in the overwritable region of the playback ring buffer 13*b*, it is determined as YES in Step S157, and the processing advances to Step S158.

In Step S158, the CPU 11 stores (overwrites) the latest musical sound data inputted in real time into the overwritable region of the playback ring buffer 13*b*.

By way of such processing, the musical sound control apparatus 1 can store the latest musical sound data that is not being inputted at the moment of operation initiation of the scratch effect into the playback ring buffer 13*b*.

For this reason, in the case of a scratch operation in the forward direction being performed, it is possible to use the musical sound data stored in the overwritable region in the overspin effect.

It thereby becomes possible to more appropriately execute an overspin effect corresponding to a scratch operation in the forward direction.

Therefore, it is possible to conduct musical sound control corresponding to a scratch operation appropriately, on the musical sound generated (played back) in real time.

The musical sound control apparatus 1 configured in the above way includes the slider 17*a*, CPU 11 and recording ring buffer 13*a*.

The slider 17*a* enables scratching in both directions.

The CPU 11 plays back musical sound data that is sequentially supplied in real time.

The recording ring buffer 13*a* stores musical sound data that is provided in sequence in real time.

In the case of a scratch operation being performed on the slider 17*a*, the CPU 11 controls so as to read out and playback the musical sound data stored in the recording ring buffer 13*a* in place of the supplied musical sound data, based on the direction of the scratch operation and operation speed.

It is thereby possible to execute a scratch effect corresponding to the scratch operation on the musical sound being inputted in real time, even in a case of a scratch operation in the playback direction of musical sound being performed.

Therefore, it becomes possible to more appropriately playback musical sound inputted in real time to correspond to a scratch operation.

In addition, the musical sound control apparatus 1 includes the recording ring buffer 13*a*.

The recording ring buffer 13*a* sequentially overwrites and stores in real time the musical sound data that is sequentially supplied.

It thereby becomes possible to execute a scratch effect according to the latest musical sound inputted in real time.

In addition, the slider 17*a* enables scratch operations in the playback direction and the opposite direction to this playback direction.

In addition, in the case of a scratch operation in the playback direction being performed on the slider 17*a*, the CPU 11 controls so as to read out and playback the musical sound data stored in the recording ring buffer 13*a* at the speed corresponding to this scratch operation and in the order of storing.

It is thereby possible to generate musical sound corresponding to the scratch operation, even in a case of a scratch operation in the playback direction of musical sound being performed on the musical sound inputted in real time.

Therefore, it becomes possible to more appropriately playback musical sound being inputted in real time to correspond to a scratch operation.

In addition, the slider 17*a* enables scratch operations in the playback direction and the opposite direction to this playback operation.

In addition, in the case of a scratch operation in the playback direction being performed on the slider 17*a*, the CPU 11 controls so as to read out and playback the musical sound data stored in the recording ring buffer 13*a* at the speed corresponding to this scratch operation and in the opposite direction to the order stored.

It is thereby possible to playback musical sound corresponding to a scratch operation, in the case of a scratch operation in the playback direction of musical sound and the opposite direction being performed on musical sound that is inputted in real time.

Therefore, it becomes possible to more appropriately playback musical sound inputted in real time to correspond to a scratch operation.

In addition, the musical sound control apparatus 1 includes the recording ring buffer 13*a* and playback ring buffer 13*b*.

The recording ring buffer 13*a* stores in real time the musical sound data that is sequentially supplied.

The playback ring buffer 13*b* copies and stores the musical sound data stored in the recording ring buffer 13*a* in the case of a scratch operation being performed on the slider 17*a*.

It is thereby possible to execute the scratch effect by retaining the musical sound data at the timing at which the scratch operation is performed.

In addition, the slider 17*a* enables scratch operations in the playback direction and the opposite direction to this playback direction.

In addition, in the case of a scratch operation being performed in the playback direction on the slider 17*a*, the CPU 11 controls so as to read out and playback the musical sound data stored in the playback ring buffer 13*b* at the speed corresponding to the scratch operation and in the order in which stored in real time.

It is thereby possible to execute a scratch effect corresponding to the scratch operation using the musical sound data at the timing at which the scratch operation was performed, even in a case of a scratch operation being performed in the playback direction of musical sound, on the musical sound being inputted in real time.

Therefore, it becomes possible to more appropriately playback musical sound inputted in real time to correspond to a scratch operation.

In addition, the slider 17*a* enables scratch operations in the playback direction and the opposite direction to this playback direction.

In addition, in the case of a scratch operation being performed in the playback direction on the slider 17*a*, the CPU 11 controls so as to read out and playback the musical data stored in the playback ring buffer 13*b* at a speed corresponding to the scratch operation, and in the opposite direction to the order stored in real time.

It is thereby possible to playback musical sound corresponding to a scratch operation using the musical sound data at the timing at which the scratch operation was performed, in the case of a scratch operation being performed in the playback direction of musical sound on the musical sound being inputted in real time.

Therefore, it becomes possible to more appropriately playback musical sound inputted in real time to correspond to a scratch operation.

In addition, the musical sound data stored in the playback ring buffer 13*b* is retained while the scratch operation is continually performed on the slider 17*a*.

Since it is thereby possible to output musical sound on which the overspin effect and backspin effect have been conducted based on the same musical sound data while the scratch operation is being performed, it is possible to suppress the musical sound data inputted in real time from being overwritten and changing during the scratch operation. In other words, similarly to a case of scratching an actual record on a turntable, a state is created of scratching on the same musical sound.

Therefore, it is possible to conduct musical sound control corresponding to a scratch operation appropriately, on the musical sound generated in real time.

In addition, in the case of a scratch operation being performed on the slider 17*a*, the CPU 11 sets the position of starting read out of musical sound data stored in the playback ring buffer 13*b* in this scratch operation as the position at which the read out of musical sound stored in the playback ring buffer 13*b* ended in the previous scratch operation.

It is thereby possible to execute a scratch effect in the playback direction of musical sound and in the opposite direction to the playback direction, by maintaining the playback position of the previous scratch effect.

For this reason, it is possible to execute a natural scratch effect in the case of a scratch operation in the playback direction of musical sound and a scratch operation in the opposite direction to the playback direction being repeated.

Therefore, it is possible to conduct musical sound control corresponding to a scratch operation appropriately, on the musical sound generated in real time.

In addition, in the case of a scratch operation being performed on the slider 17*a*, for the initial scratch operation, the CPU 11 controls so as to read out and playback the musical sound data stored in the playback ring buffer 13*b* in the opposite direction to the order stored in real time, and for subsequent scratch operations, controls so as to read out and playback musical sound data stored in the playback ring buffer 13*b* in the direction of this scratch operation.

In the case of a scratch operation being performed, it is thereby possible to avoid a situation such as muting immediately after the scratch operation, because the backspin effect is executed without exception.

Therefore, it is possible to conduct musical sound control corresponding to a scratch operation appropriately, on the musical sound generated in real time.

In addition, in the case of a scratch operation being performed on the slider 17*a*, the CPU 11 controls so as to read out and playback the musical sound data stored in the playback ring buffer 13*b*, when the initial scratch operation is a scratch operation in the same direction as the playback direction of musical sound.

It is thereby possible to avoid a situation such as muting immediately after the scratch operation.

Therefore, it is possible to conduct musical sound control corresponding to a scratch operation appropriately, on the musical sound generated in real time.

In addition, a partial region of the playback ring buffer 13*b* enables the musical sound data stored in the recording ring buffer 13*a* to be overwritten while the stored musical sound data is being read out and played back according to the scratch operation.

It is thereby possible to store the latest musical sound data that is not being inputted at the moment of operation start of the scratch effect in the playback ring buffer 13*b*.

For this reason, in the case of a scratch operation being performed in the playback direction, it is possible to use musical sound data being stored in the partial region of the playback ring buffer 13*b* in the scratch effect in the playback direction.

It thereby becomes possible to more appropriately execute a scratch effect, corresponding to a scratch operation in the playback direction.

Therefore, it is possible to conduct musical sound control corresponding to a scratch operation appropriately, on the musical sound generated in real time.

It should be noted that the present invention is not to be limited to the aforementioned embodiments, and that modifications, improvements, etc. within a scope capable of achieving the objects of the present invention are also included thereby.

Although examples of receiving scratch operations by way of causing the slider 17*a* to move are explained in the aforementioned embodiments, the form of the scratch operation is not limited thereto.

For example, as the input unit 17 for scratch operations, it is possible to include a switch for a scratch operation in a forward direction and a switch for a scratch operation in the opposite direction; include an analog operator like a horizontal fader; etc.

In addition, in the aforementioned embodiments, the musical sound control apparatus 1 to which the present invention is applied has been explained by giving the example of dedicated hardware; however, it is not limited thereto.

For example, the present invention can be applied to general use electronic devices. More specifically, the present invention is applicable to electronic musical instruments such as an electric piano, notebook-type personal computers, portable telephone devices, smartphones, portable game consoles, etc.

The aforementioned series of processing can be implemented by hardware, and can be implemented by software.

In the case of having the sequence of processing executed by software, the program constituting this software is installed into a computer or the like from a network or recording medium. The computer may be a computer embedding with dedicated hardware. In addition, the computer may be a computer capable of executing various functions, e.g., a general purpose personal computer, by installing various programs.

In the case of having the series of processing executed by software, a program constituting this software is installed from a network or recording medium to a computer or the like. The computer may be a computer built into dedicated hardware. In addition, the computer may be a computer capable of executing various functions by installing various programs, e.g., a general-purpose personal computer.

The storage medium containing such a program not only can be constituted by the removable medium 31 shown in FIG. 2 which is distributed separately from the device main body in order to supply the program to a user, but also can be constituted by a storage medium or the like supplied to the user in a state incorporated in the device main body in advance. The removable medium 31 is composed of, for example, a magnetic disk (including a floppy disk), an optical disk, a magnetic optical disk, or the like. The optical disk is composed of, for example, a CD-ROM (Compact Disk-Read Only Memory), a DVD (Digital Versatile Disk), a Blu-ray (registered trademark) disk (Blu-ray Disk) or the like. The magnetic optical disk is composed of an MD (Mini-Disk) or the like. In addition, the storage medium supplied to the user in a state incorporated in the device main body in advance may include, for example, the ROM 12 shown in FIG. 2, a hard disk included in the storage unit 20 shown in FIG. 2 or the like, in which the program is recorded.

It should be noted that, in the present disclosure, the steps describing the program recorded in the storage medium include not only the processing executed in a time series following this order, but also processing executed in parallel or individually, which is not necessarily executed in a time series.

Although some embodiments of the present invention have been described above, the embodiments are merely exemplifications, and are not to limit the technical scope of the present invention. Various other embodiments can be assumed for the present invention, and various modifications such as omissions and replacements are possible without departing from the spirit of the present invention. Such embodiments and modifications are included in the scope of the invention and the summary described in the present disclosure, and are included in the invention recited in the claims as well as the equivalent scope thereof.

What is claimed is:

1. A musical sound control apparatus, comprising:

an operator that is operable to perform a scratch operation in first and second directions;

a first ring buffer that, in response to input of a sound of an external musical sound data being supplied externally, sequentially overwrites and stores the external musical sound data;

a second ring buffer that, in a case of a scratch operation being performed on the operator, copies at least one piece of musical sound data stored in the first ring buffer and stores the at least one piece of musical sound data; and a playback control unit that controls the musical sound data stored in the second ring buffer based on the scratch operation performed in at least one of the first direction and the second direction so as to read out and playback the musical sound data stored in the second ring buffer.

2. The musical sound control apparatus according to claim 1, wherein the operator is operable to perform a scratch operation in a same direction as a playback direction and an opposite direction to the playback direction, and wherein the playback control unit controls the musical sound data so as to read out and playback the musical sound data stored in the second ring buffer in an order stored, at a speed corresponding to the scratch operation, in a case of a scratch operation being performed in the playback direction on the operator.

3. The musical sound control apparatus according to claim 1, wherein the operator is operable to perform a scratch operation in a same direction as a playback direction and an opposite direction to the playback direction, as the first direction and the second direction, respectively, and wherein the playback control unit controls the musical sound data stored in the second ring buffer so as to read out and playback the musical sound data in an opposite direction to an order stored, at a speed corresponding to the scratch operation, in a case of a scratch operation being performed in the playback direction on the operator.

4. The musical sound control apparatus according to claim 1, wherein the musical sound data stored in the second ring buffer is retained while a scratch operation is continuously performed on the operator.

5. The musical sound control apparatus according to claim 4, wherein the playback control unit sets a position at which to start read out of the musical sound data stored in the second ring buffer in the scratch operation as a position at which read out of musical sound data stored in the second ring buffer ended in a previous scratch operation, in a case of a scratch operation being performed on the operator.

6. The musical sound control apparatus according to claim 5, wherein the playback control unit, for an initial scratch operation, controls so as to read out and playback the musical sound data stored in the second ring buffer in an opposite direction to an order stored, and for a subsequent scratch operation, controls so as to read out and playback the musical sound data stored in the second ring buffer in a direction corresponding to a direction of the scratch operation, in a case of a scratch operation being performed on the operator.

7. The musical sound control apparatus according to claim 5, wherein the playback control unit controls so as to read out and playback the musical sound data stored in the second ring buffer, when an initial scratch operation is a scratch operation in a same direction as a playback direction of musical sound, as one of the first direction and the second direction, in a case of a scratch operation being performed on the operator.

8. The musical sound control apparatus according to claim 1, wherein a partial region of the second ring buffer is configured to enable overwriting of musical sound data stored in the first ring buffer, while reading out and playing back the musical sound data stored to correspond to the scratch operation.

9. An electronic musical instrument comprising:

a plurality of operators;

the musical sound control apparatus according to claim 1; and a sound source that, in response to manipulation of any operator among the plurality of operators, generates musical sound that is controlled by the musical sound control apparatus, at a pitch corresponding to the operator manipulated.

10. A musical sound control method used by a musical sound control apparatus which includes (i) an operator that is operable to perform a scratch operation in first and second directions, (ii) a first ring buffer, and (iii) a second ring buffer, the method comprising:

in response to input of a sound of an external musical sound data being supplied externally, sequentially overwriting and storing the external musical sound data in the first ring buffer;

in a case of a scratch operation being performed on the operator, copying at least one piece of musical sound data stored in the first ring buffer and storing the at least one piece of musical sound data in the second ring buffer; and controlling the musical sound data stored in the second ring buffer based on the scratch operation performed in at least one of the first direction and the second direction so as to read out and playback the musical sound data stored in the second ring buffer.

11. A non-transitory computer-readable storage medium having stored thereon a program that is executable by a musical sound control apparatus which includes (i) an operator that is operable to perform a scratching operation in first and second directions, (ii) a first ring buffer, and (iii) a second ring buffer, the program being executable by the musical sound control apparatus to perform functions comprising:

in response to input of a sound of an external musical sound data being supplied externally, sequentially overwriting and storing the external musical sound data in the first ring buffer;

in a case of a scratch operation being performed on the operator, copying at least one piece of musical sound data stored in the first ring buffer and storing the at least one piece of musical sound data in the second ring buffer; and controlling the musical sound data stored in the second ring buffer based on the scratch operation performed in at least one of the first direction and the second direction so as to read out and playback the musical sound data stored in the second ring buffer.

* * * * *